US010773534B2

(12) United States Patent
Nishida

(10) Patent No.: US 10,773,534 B2
(45) Date of Patent: Sep. 15, 2020

(54) RECORDING APPARATUS AND RECORDING METHOD

(71) Applicant: CANON KABUSHIKI KAISHA, Tokyo (JP)

(72) Inventor: Tomofumi Nishida, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/442,056

(22) Filed: Jun. 14, 2019

(65) Prior Publication Data

US 2020/0001631 A1 Jan. 2, 2020

(30) Foreign Application Priority Data

Jun. 28, 2018 (JP) ..... 2018-123752

(51) Int. Cl.
*B41J 13/00* (2006.01)

(52) U.S. Cl.
CPC ..... *B41J 13/0027* (2013.01)

(58) Field of Classification Search
CPC ..... B41J 13/0027; B41J 13/0018
See application file for complete search history.

(56) References Cited

U.S. PATENT DOCUMENTS

| | | | | |
|---|---|---|---|---|
| 6,999,194 | B2 * | 2/2006 | Kurihara | B41J 11/42 347/19 |
| 9,278,565 | B2 * | 3/2016 | Imafuku | B41J 13/0009 |
| 9,864,937 | B2 * | 1/2018 | Saito | G06K 15/4025 |
| 10,569,575 | B2 * | 2/2020 | Hidaka | B41J 13/0009 |
| 2016/0052311 | A1 * | 2/2016 | Taniguchi | B41J 11/0095 347/16 |
| 2017/0274681 | A1 * | 9/2017 | Ide | B41J 13/0009 |
| 2017/0334219 | A1 * | 11/2017 | Ito | B65H 9/006 |

FOREIGN PATENT DOCUMENTS

JP 2006-175642 A 7/2006

* cited by examiner

*Primary Examiner* — Julian D Huffman
(74) *Attorney, Agent, or Firm* — Canon U.S.A., Inc. IP Division

(57) ABSTRACT

There is provided a recording apparatus that start conveying a subsequent sheet in a state where an overlap amount of a preceding sheet and the subsequent sheet is not determined, acquires the overlap amount after the sheet conveyance is started, acquires distance information about a distance between a trailing edge of an image of a last line on the preceding sheet and a leading edge of an image on the subsequent sheet based on recording data and the overlap amount, and generates recording data for image forming of recording data of the last line on the preceding sheet and recording data of a first line on the subsequent sheet in the same scan by a recording unit, based on the acquired distance information.

10 Claims, 13 Drawing Sheets

CASE 1

CASE 2

RECORDING APPARATUS AND RECORDING METHOD

BACKGROUND

Field

One disclosed aspect of the embodiments relates to a recording apparatus and a recording method for performing recording on a sheet using a recording head.

Description of the Related Art

There are demands for an improved recording throughput of a recording apparatus configured to perform continuous recording on a plurality of sheets, in order to reduce the printing time. The time period between recording on a preceding sheet and a start of recording on a subsequent sheet can be reduced by reducing sheet feeding intervals.

Japanese Patent Application Laid-Open No. 2006-175642 discusses a recording apparatus in which partially a trailing edge portion of a preceding recording sheet and a leading edge portion of a subsequent recording sheet are overlapped and conveyed to a position facing a recording unit, and simultaneous recording is performed on the trailing edge side portion of the preceding sheet and the leading edge side portion of the subsequent sheet. According to Japanese Patent Application Laid-Open No. 2006-175642, the recording throughput can be increased by performing recording in an increased overlap state in a case of a large margin amount.

In a case where sheets are overlapped before margins of the sheets are known, the overlap can be so large that a portion of the preceding sheet on which an image is to be recorded is overlapped by the other sheet, or the overlap amount can be so small that the last line on the preceding sheet and the first line on the subsequent sheet cannot be recorded by the same scan.

Accordingly, an attempt may be made to determine the overlap amount based on the margin amount and overlap the sheets based on the determination. However, in order to calculate the margin amount, recording data about the trailing edge of the preceding sheet and recording data about the leading edge of the subsequent sheet need to be processed, and this processing takes time. Further, feeding of the subsequent sheet cannot be started until the overlap amount is determined, so that it takes time to feed recording sheets.

SUMMARY

One disclosed aspect of the embodiments is directed to a technique for preventing a decrease in throughput during execution of recording on consecutively conveyed sheets. According to an aspect of the embodiments, a recording apparatus includes a generation unit, a recording unit, a sheet conveyance unit, and an acquisition unit. The generation unit is configured to generate recording data to be used for recording by processing input data. The recording unit includes a plurality of recording elements arranged in a predetermined direction and is configured to record an image on a sheet located at a recording position based on the recording data while performing scanning in a direction intersecting with the predetermined direction. The sheet conveyance unit is configured to form an overlap state where a trailing edge portion of a preceding sheet and a leading edge portion of a subsequent sheet overlap, and convey the preceding sheet and the subsequent sheet so as to convey the preceding sheet and the subsequent sheet in the overlap state to the recording position. The acquisition unit is configured to acquire overlap information and distance information. The acquisition unit is configured to acquire information about an overlap amount between the preceding sheet and the subsequent sheet when the preceding sheet and the subsequent sheet are conveyed to the recording position, based on a position of a trailing edge of an image of a last line on the preceding sheet in the predetermined direction determined based on the recording data. The acquisition unit is configured to acquire distance information about a distance between a leading edge of an image of a last line on the preceding sheet and a leading edge of an image on the subsequent sheet in the predetermined direction when the preceding sheet and the subsequent sheet are conveyed to the recording position based on the acquired overlap amount and the recording data. The sheet conveyance unit starts conveying the subsequent sheet before the acquisition unit acquires the information about the overlap amount. The generation unit generates, based on the distance information acquired by the acquisition unit, data for recording the last line on the preceding sheet and a first line on the subsequent sheet in a same scan by the recording unit.

Further features of the disclosure will become apparent from the following description of exemplary embodiments with reference to the attached drawings.

DESCRIPTION OF THE EMBODIMENTS

Figure 1:
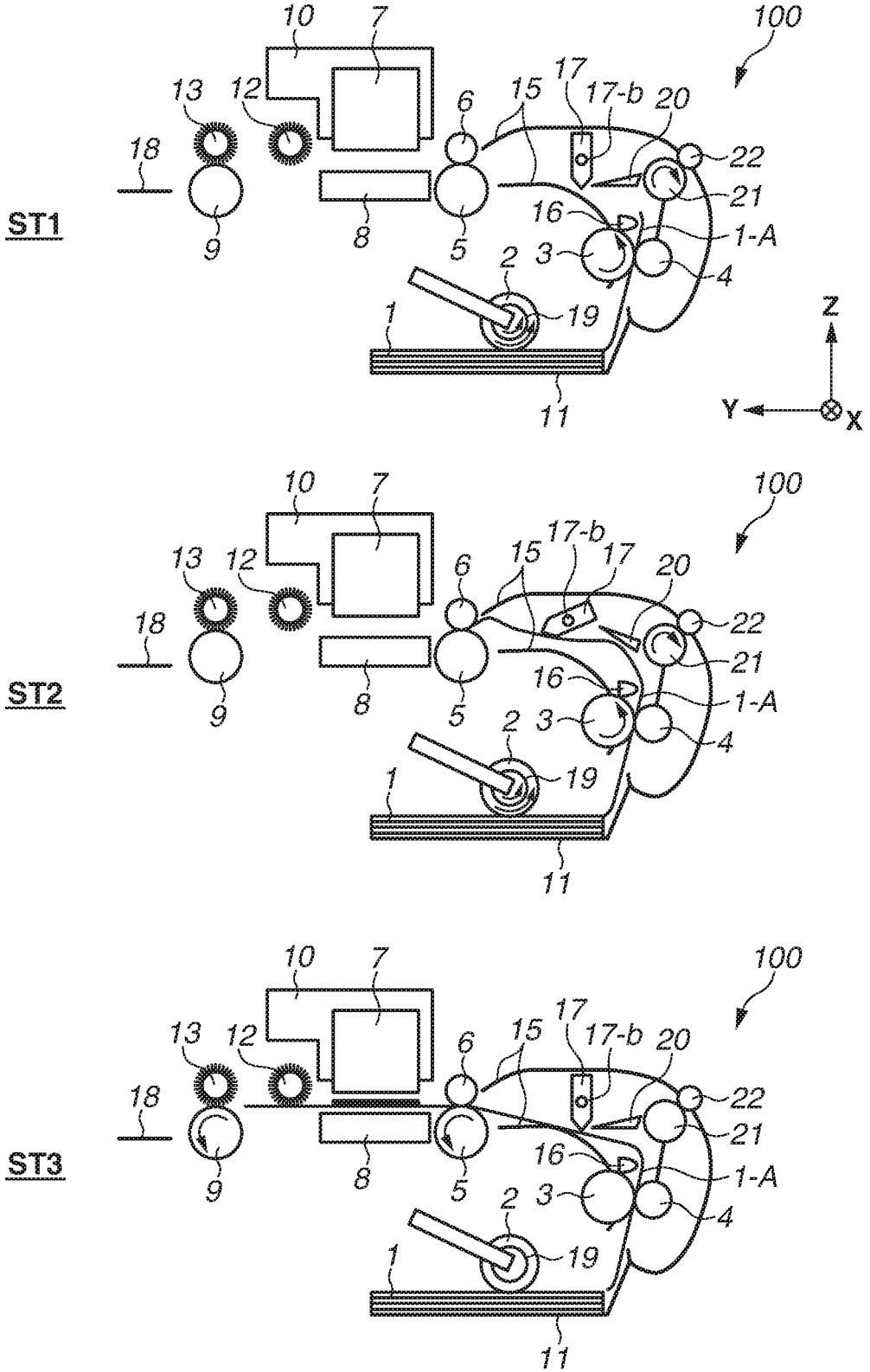
FIG. 1 illustrates a continuous overlapping sheet feeding operation of a recording apparatus according to an exemplary embodiment.

An exemplary embodiment of the disclosure will be described in detail below with reference to the attached drawings. Structures having similar functions are given the same reference numerals in the drawings, and descriptions thereof are sometimes omitted.

Figure 2:
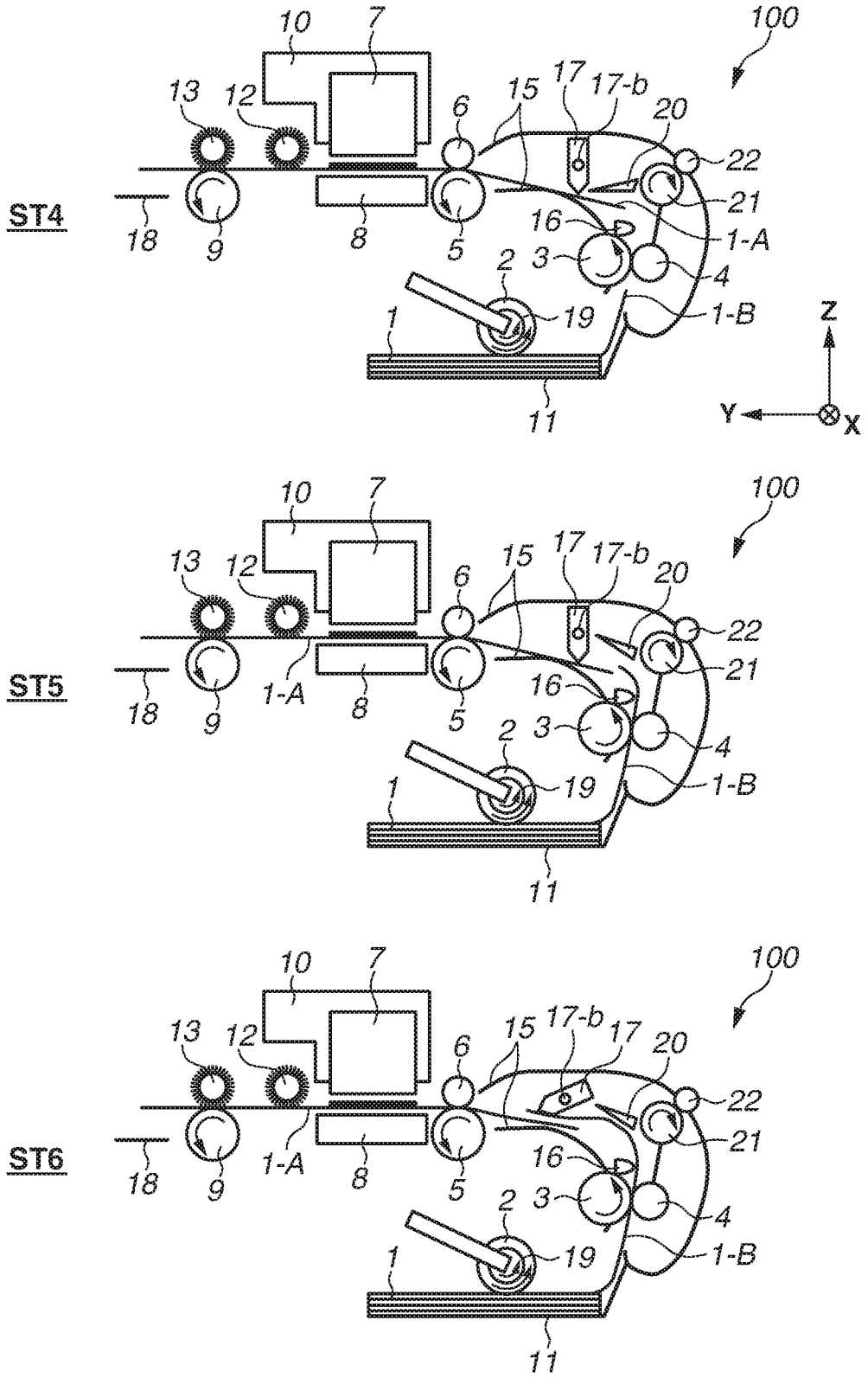
FIG. 2 illustrates the continuous overlapping sheet feeding operation of the recording apparatus according to the exemplary embodiment.
Figure 3:
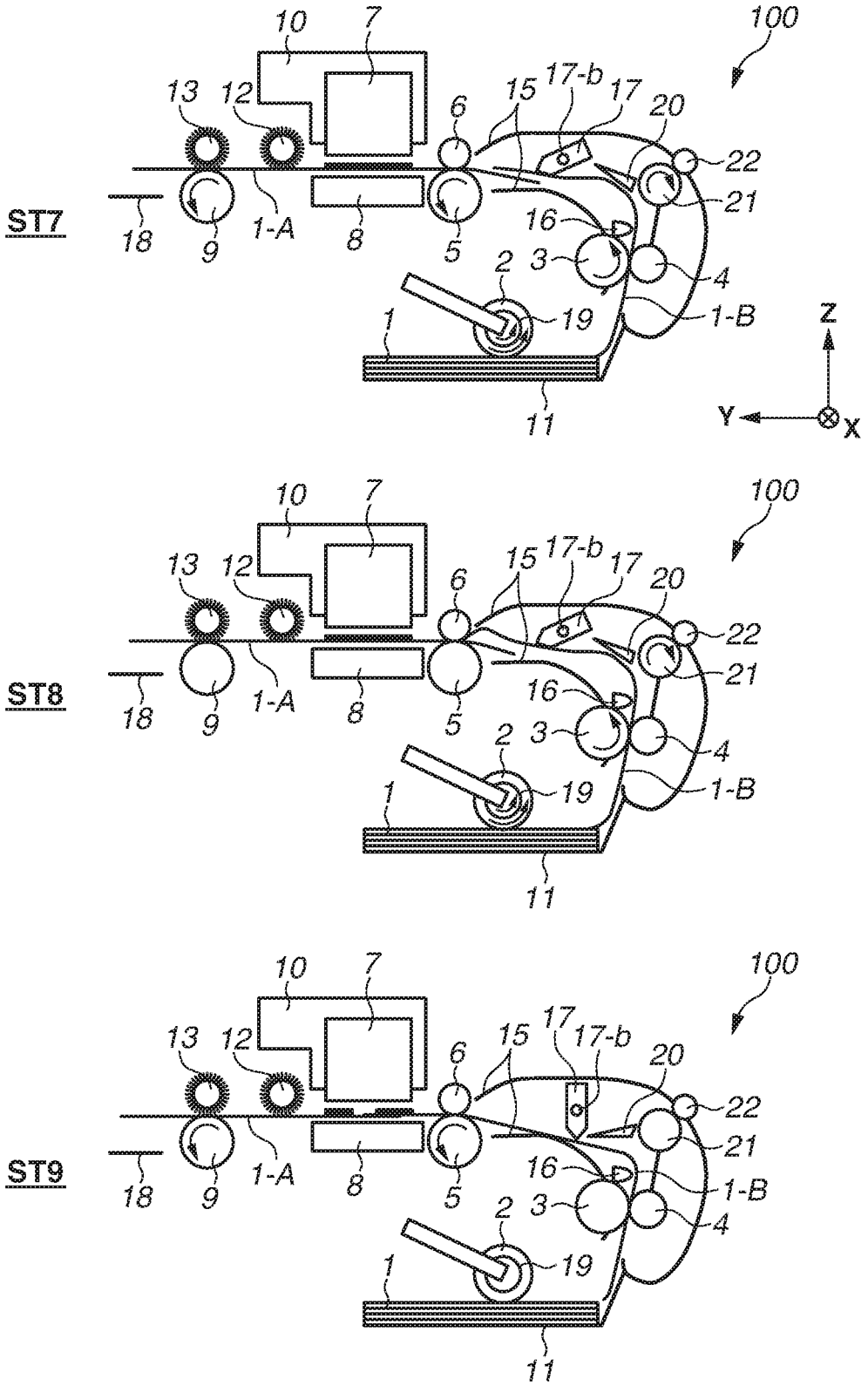
FIG. 3 illustrates an operation of printing on preceding and subsequent sheets by a single scan in the continuous overlapping sheet feeding operation of the recording apparatus according to the exemplary embodiment.

FIGS. 1 to 3 are cross-sectional diagrams schematically illustrating a recording apparatus according to an exemplary embodiment and illustrate a continuous overlapping sheet feeding operation. First, a schematic structure of the recording apparatus according to the present exemplary embodiment will be described below with reference to a state ST1 illustrated in FIG. 1.

The scope of the term "recording" broadly encompasses not only a case of forming significant information such as a character or figure but also a case of forming significant/insignificant information such as an image, design, or pattern on a recording medium or processing a medium, regardless of whether the recording is visualization of information so as to enable a person to visually recognize the information. Further, while a sheet-shaped paper sheet is described as a recording medium in the present exemplary embodiment, the recording medium can be a cloth, plastic, or film. A sheet-shaped recording medium is referred to as "recording sheet" in the present specification.

A configuration of a recording apparatus 100 will be described below with reference to the state ST1 in FIG. 1. A plurality of recording sheets 1 is stacked on a sheet feeding tray 11 (sheet stacking portion). A pickup roller 2 is brought into contact with the uppermost recording sheet 1 stacked on the sheet feeding tray 11 and picks up the uppermost recording sheet 1. A sheet feeding roller 3 feeds the recording sheet 1 picked up by the pickup roller 2 toward a downstream side in a sheet conveyance direction. A sheet feeding driven roller 4 biased against the sheet feeding roller 3 pinches the recording sheet 1 with the sheet feeding roller 3, and feeds the recording sheet 1.

A sheet conveyance roller 5 conveys the recording sheet 1 fed by the sheet feeding roller 3 and the sheet feeding driven roller 4 to a position opposing a recording head 7. A pinch roller 6 is biased against the sheet conveyance roller 5, and the pinch roller 6 and the sheet conveyance roller 5 pinch and convey the recording sheet 1.

The recording head 7 performs recording on the recording sheet 1 conveyed by the sheet conveyance roller 5 and the pinch roller 6. In the present exemplary embodiment, the recording head 7 is described as an inkjet recording head configured to perform recording on the recording sheet 1 by discharging ink from discharge openings arranged in a recording sheet conveyance direction (predetermined direction). A platen 8 supports a rear surface of the recording sheet 1 at a recording position opposing the recording head 7. A carriage 10 with the recording head 7 mounted thereon is moved to a direction intersecting with the sheet conveyance direction.

A sheet discharge roller 9 discharges the recording sheet 1 having undergone the recording by the recording head 7 to the outside of the recording apparatus 100. Spurs 12 and 13 are brought into contact with a recording surface of the recording sheet 1 having undergone the recording by the recording head 7 and are rotated. The spur 13 located downstream is biased against the sheet discharge roller 9, whereas no sheet discharge roller 9 is provided at a position opposing the spur 12 located upstream. The spur 12 is provided to prevent the recording sheet 1 from being raised and is also referred to as a presser spur. The discharged recording sheet 1 is stacked on a sheet discharge tray (sheet discharge portion) 18.

Between a sheet feeding nip portion formed by the sheet feeding roller 3 and the sheet feeding driven roller 4 and a sheet conveyance nip portion formed by the sheet conveyance roller 5 and the pinch roller 6, the recording sheet 1 is guided by a sheet conveyance guide 15. A sheet detection sensor 16 detects leading and trailing edges of the recording sheet 1. The sheet detection sensor 16 is provided downstream of the sheet feeding roller 3 in the sheet conveyance direction. A sheet pressing lever 17 overlaps a leading edge portion of a subsequent sheet and a trailing edge portion of a preceding sheet. The sheet pressing lever 17 is biased around a rotation shaft 17*b* in an anti-clockwise direction in FIG. 1.

Figure 4A:
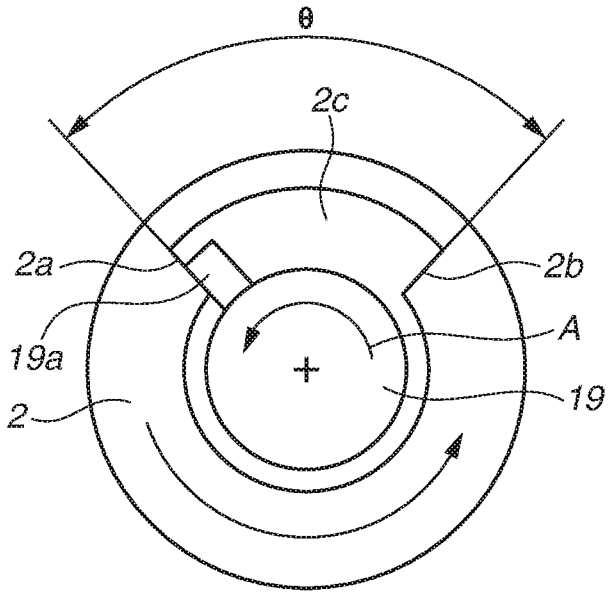
FIGS. 4A and 4B are schematic diagrams illustrating a structure of a pickup roller of the recording apparatus according to the exemplary embodiment.
Figure 4B:
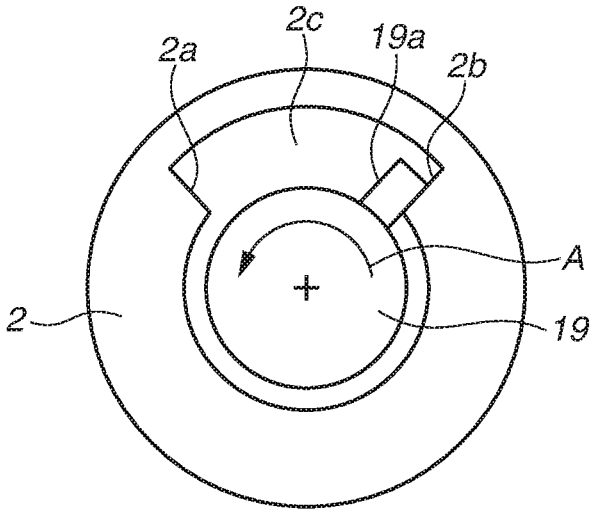

FIG. 4 illustrates a structure of the pickup roller 2. As described above, the pickup roller 2 is brought into contact with an uppermost recording sheet stacked on the sheet feeding tray 11 and picks up the recording sheet. A driving shaft 19 transmits the driving force of a sheet feeding motor 206 described below to the pickup roller 2. At the time of picking up the recording sheet, the driving shaft 19 and the pickup roller 2 are rotated in the direction of an arrow A in FIG. 2. The driving shaft 19 is provided with a protrusion 19*a*. The pickup roller 2 includes a depressed portion 2*c* into which the protrusion 19*a* is to be fitted. As illustrated in FIG. 4A, in a case where the protrusion 19*a* is in contact with a first surface 2*a* of the depressed portion 2*c* of the pickup roller 2, the driving force of the driving shaft 19 is transmitted to the pickup roller 2, so that if the driving shaft 19 is driven, the pickup roller 2 is also rotated. On the other hand, as illustrated in FIG. 4B, in a case where the protrusion 19*a* is in contact with a second surface 2*b* of the depressed portion 2*c* of the pickup roller 2, the driving force of the driving shaft 19 is not transmitted to the pickup roller 2, so that even if the driving shaft 19 is driven, the pickup roller 2 is not rotated. Further, the pickup roller 2 is not rotated even if the driving shaft 19 is driven also in a case where the protrusion 19*a* is in contact with neither the first surface 2*a* nor the second surface 2*b* and is located between the first surface 2*a* and the second surface 2*b*.

Figure 5:
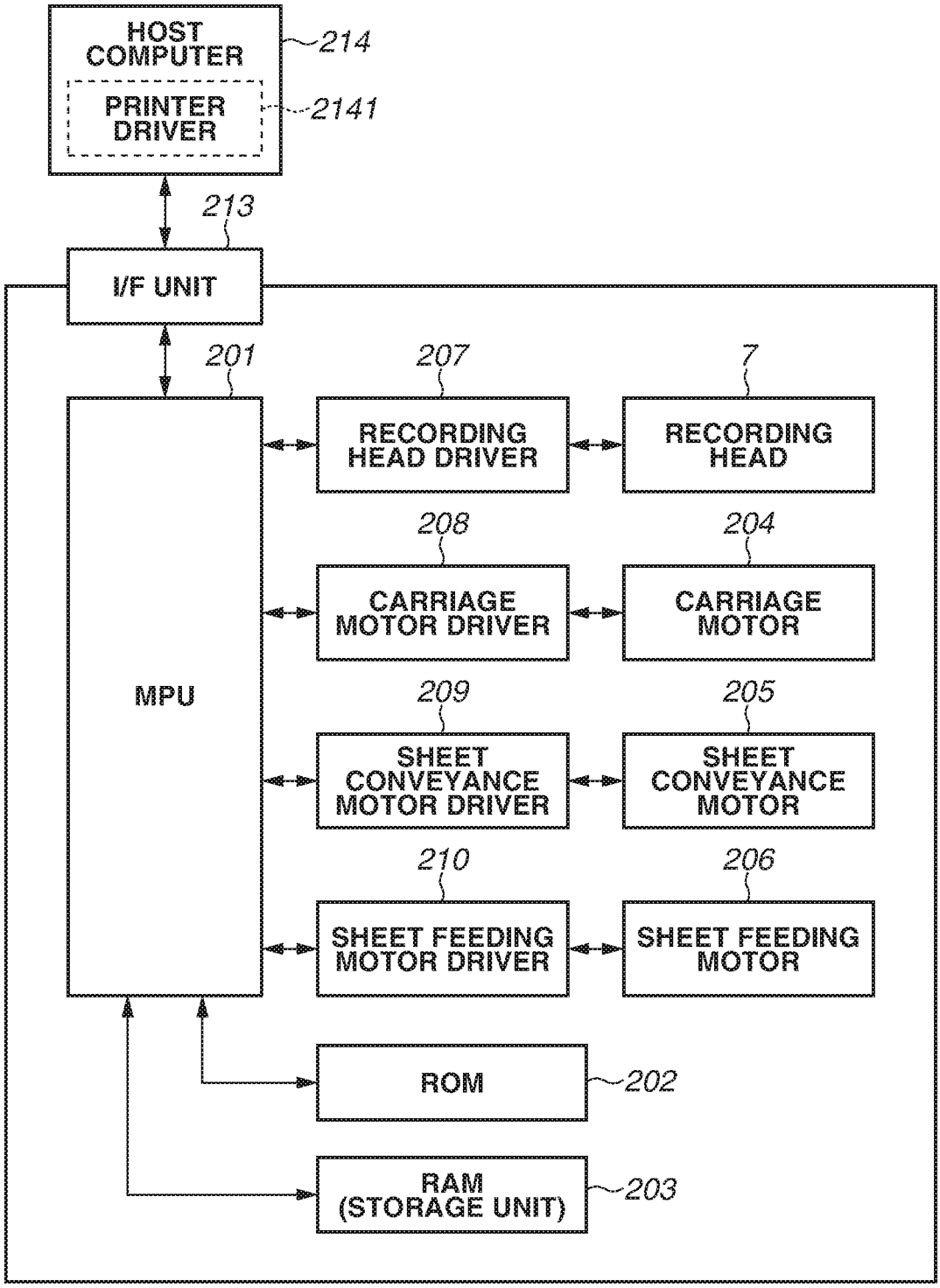
FIG. 5 is a block diagram illustrating a configuration of a control system of the recording apparatus according to the exemplary embodiment.

FIG. 5 is a block diagram illustrating the recording apparatus 100 according to the present exemplary embodiment. A micro-processing unit (MPU) 201 controls operations of each component and data processing. The MPU 201 may be a processor or a device that can be programmed to perform operations described in the following. As described below, the MPU 201 also functions as a sheet conveyance control unit capable of controlling recording sheet conveyance so as to overlap a trailing edge portion of a preceding recording sheet and a leading edge portion of a subsequent sheet. A read-only memory (ROM) 202 stores a program and data to be executed by the MPU 201. The program may include instructions that, when executed by the MPU 201, cause the MPU 201 to perform operations described in the following. A random access memory (RAM) 203 temporarily stores processing data to be executed by the MPU 201 and data received from a host computer 214. The RAM 203 does not need enough capacity for storing all recording data about a preceding sheet and all recording data about a subsequent sheet, and in the present exemplary embodiment, the RAM 203 is only required to have enough capacity for performing image forming in three scans by the recording head 7. An interface (I/F) unit 213 is provided in the recording apparatus 100, and input data such as recording image and other data transmitted from the host computer 214 into the MPU 201.

The recording head 7 includes the ink discharge openings, a heat generation element configured to generate energy for ink discharge, and a recording element, such as a piezo element, and is controlled by a recording head driver 207. A carriage motor 204 configured to drive the carriage 10 is controlled by a carriage motor driver 208. The sheet conveyance roller 5 and the sheet discharge roller 9 are driven by a sheet conveyance motor 205. The sheet conveyance motor 205 is controlled by a sheet conveyance motor driver 209. The pickup roller 2 and the sheet feeding roller 3 are driven by the sheet feeding motor 206. The sheet feeding motor 206 is controlled by a sheet feeding motor driver 210. The position of the recording head 7 and the rotation amount of the sheet conveyance roller 5 can be detected by a sensor (not illustrated).

The host computer 214 is provided with a printer driver 2141 configured to communicate with the recording apparatus 100 to transmit a recording image and recording information such as recording image quality in a case where a user instruction to execute a recording operation is issued. The MPU 201 exchange a recording image and other data with the host computer 214 via the I/F unit 213.

Operation Example

A continuous overlapping sheet feeding operation will be described in time-series below with reference to the state ST1 in FIG. 1 to a state ST9 in FIG. 3. If input data is transmitted from the host computer 214 to the I/F unit 213, the recording data is processed by the MPU 201 and then rasterized into the RAM 203. The MPU 201 starts a recording operation based on the rasterized data.

The operation will be described below with reference to the state ST1 in FIG. 1. First, the sheet feeding motor driver 210 drives the sheet feeding motor 206 at low speed. With this operation, the pickup roller 2 is rotated at 7.6 inch/sec. When the pickup roller 2 is rotated, the uppermost recording sheet (preceding sheet 1-A) stacked on the sheet feeding tray 11 is picked up. The preceding sheet 1-A picked up by the pickup roller 2 is conveyed by the sheet feeding roller 3 rotated in the same direction as the rotation of the pickup roller 2. The sheet feeding roller 3 is also driven by the sheet feeding motor 206. In the present exemplary embodiment, the structure including the pickup roller 2 and the sheet feeding roller 3 is described. However, a structure including only a sheet feeding roller configured to feed a recording sheet stacked on a sheet stacking portion may be employed.

If the sheet detection sensor 16 provided downstream of the sheet feeding roller 3 detects a leading edge of the preceding sheet 1-A, the sheet feeding motor 206 is switched to high-speed driving. As a result, the pickup roller 2 and the sheet feeding roller 3 are rotated at 20 inch/sec.

The operation will be described below with reference to the state ST2 in FIG. 1. The sheet feeding roller 3 is continuously rotated so that the leading edge of the preceding sheet 1-A rotates the sheet pressing lever 17 about the rotation shaft 17*b* in the clockwise direction against the biasing force of the spring. The sheet feeding roller 3 is further rotated and the leading edge of the preceding sheet 1-A bumps into the sheet conveyance nip portion formed by the sheet conveyance roller 5 and the pinch roller 6. At this time, the sheet conveyance roller 5 is in a stopped state. The sheet feeding roller 3 is rotated by a predetermined amount after the leading edge of the preceding sheet 1-A bumps into the sheet conveyance nip portion, so that the leading edge of the preceding sheet 1-A in the state of bumping into the sheet conveyance nip portion is aligned to thereby correct the skew. The skew correction operation is also referred to as "registration operation".

The operation will be described below with reference to the state ST3 in FIG. 1. After the skew correction operation on the preceding sheet 1-A is ended, the sheet conveyance motor 205 is driven to start rotating the sheet conveyance roller 5. The sheet conveyance roller 5 conveys the sheets at 15 inch/sec. The preceding sheet 1-A is head-aligned to the position opposing the recording head 7, and thereafter the recording head 7 discharges ink based on the recording data to thereby perform a recording operation. In the head alignment operation, the leading edge of the recording sheet is caused to bump into the sheet conveyance nip portion and is thereby positioned at the position of the sheet conveyance roller 5, and thereafter the rotation amount of the sheet conveyance roller 5 is controlled using the position of the sheet conveyance roller 5 as a reference.

The recording apparatus 100 according to the present exemplary embodiment is a serial type recording apparatus (hereinafter, "serial printer") in which the recording head 7 is mounted on the carriage 10. The recording apparatus 100 repeats the sheet conveyance operation, in which the sheet conveyance roller 5 intermittently conveys a recording sheet by a predetermined amount, and the image forming operation in which the recording head 7 discharges ink by moving the carriage 10 with the recording head 7 mounted thereon when the sheet conveyance roller 5 is stopped. This operation is performed to thereby perform the recording operation on the recording sheet.

When the preceding sheet 1-A is head-aligned, the sheet feeding motor 206 is switched to low-speed driving. Specifically, the pickup roller 2 and the sheet feeding roller 3 is rotated at 7.6 inch/sec. When the sheet conveyance roller 5 intermittently conveys the recording sheet by the predetermined amount, the sheet feeding motor 206 intermittently drives the sheet feeding roller 3. In other words, when the sheet conveyance roller 5 is rotated, the sheet feeding roller 3 is also rotated, and when the sheet conveyance roller 5 is stopped, the sheet feeding roller 3 is also stopped. The rotation speed of the sheet feeding roller 3 is slower than the rotation speed of the sheet conveyance roller 5. Thus, the sheet is stretched between the sheet conveyance roller 5 and the sheet feeding roller 3. Further, the sheet feeding roller 3 is dragged by the recording sheet conveyed by the sheet conveyance roller 5.

The sheet feeding motor 206 is intermittently driven to drive the driving shaft 19. As described above, the rotation speed of the pickup roller 2 is slower than the rotation speed of the sheet conveyance roller 5. Thus, the pickup roller 2 is dragged by the recording sheet conveyed by the sheet conveyance roller 5. In other words, the pickup roller 2 is in a proactive state with respect to the driving shaft 19. More specifically, the protrusion 19*a* of the driving shaft 19 is separated from the first surface 2*a* and is in contact with the second surface 2*b*. Accordingly, when a trailing edge of the preceding sheet 1-A passes through the pickup roller 2, the second recording sheet (subsequent sheet 1-B) is not immediately picked up. If the driving shaft 19 is driven for a predetermined time period, the protrusion 19*a* comes into contact with the first surface 2*a*, and the pickup roller 2 starts rotating. At this time point, the position of the trailing edge of an image to be recorded on the preceding sheet 1-A, i.e., the trailing edge of the last line, is not known. Further, the position of the leading edge of an image on the subsequent sheet 1-B is also not known.

The operation will be described below with reference to the state ST4 in FIG. 2. In the state ST4, the pickup roller 2 starts rotating, and the subsequent sheet 1-B is picked up. In order for the sheet detection sensor 16 to detect an edge portion of a recording sheet, a predetermined interval or longer is needed between sheets due to the responsiveness of the sheet detection sensor 16. In other words, the trailing edge portion of the preceding sheet 1-A and the leading edge portion of the subsequent sheet 1-B need to be separated by a predetermined distance so that there is a predetermined time interval after the sheet detection sensor 16 detects the trailing edge of the preceding sheet 1-A and before the sheet detection sensor 16 detects the leading edge of the subsequent sheet 1-B. With this reason, the depressed portion 2*c* of the pickup roller 2 is set to about 70 degrees.

The operation will be described below with reference to the state ST5 in FIG. 2. The subsequent sheet 1-B picked up by the pickup roller 2 is conveyed by the sheet feeding roller 3. At this time, the recording head 7 performs an image forming operation on the preceding sheet 1-A based on the recording data. When the sheet detection sensor 16 detects the leading edge of the subsequent sheet 1-B, the sheet feeding motor 206 is switched to high-speed driving. More specifically, the pickup roller 2 and the sheet feeding roller 3 are rotated at 20 inch/sec.

The operation will be described below with reference to the state ST6 in FIG. 2. The trailing edge portion of the preceding sheet 1-A is pressed downward by the sheet pressing lever 17 as illustrated in the state ST5 in FIG. 2. The subsequent sheet 1-B is moved at a higher speed than the speed at which the preceding sheet 1-A is moved downstream by the recording operation performed by the recording head 7, whereby a state where the leading edge portion of the subsequent sheet 1-B overlaps on the trailing edge portion of the preceding sheet 1-A is formed (state ST6 in FIG. 2). Since the recording operation is performed on the preceding sheet 1-A based on the recording data, the preceding sheet 1-A is intermittently conveyed by the sheet conveyance roller 5. Meanwhile, the sheet feeding roller 3 is continuously rotated at 20 inch/sec after the sheet detection sensor 16 detects the leading edge of the subsequent sheet 1-B, so that the subsequent sheet 1-B catches up with the preceding sheet 1-A.

The operation will be described below with reference to the state ST7 in FIG. 3. After the overlap state where the leading edge portion of the subsequent sheet 1-B overlaps on the trailing edge portion of the preceding sheet 1-A is formed, the subsequent sheet 1-B is conveyed by the sheet feeding roller 3 until the leading edge of the subsequent sheet 1-B stops at a predetermined position located upstream of the sheet conveyance nip. The position of the leading edge of the subsequent sheet 1-B is calculated from an amount by which the sheet feeding roller 3 is rotated from the time point at which the leading edge of the subsequent sheet 1-B is detected by the sheet detection sensor 16, and the position of the leading edge of the subsequent sheet 1-B is controlled based on the calculation result. At this time, an image forming operation is performed on the preceding sheet 1-A by the recording head 7 based on the recording data.

The operation will be described below with reference to the state ST8 in FIG. 3. The sheet conveyance roller 5 is stopped in order to perform an image forming operation (ink discharge operation) with respect to the first line from the last line on the preceding sheet 1-A. When the recording data about the subsequent sheet 1-B is transmitted from the host computer 214 via the I/F unit 213, the sheet feeding roller 3 is driven, and the leading edge of the subsequent sheet 1-B is caused to bump into the sheet conveyance nip portion to thereby perform a skew correction operation on the subsequent sheet 1-B.

When the skew correction operation on the subsequent sheet 1-B is ended, the driving of the sheet feeding motor 206 is stopped. Further, the driving force transmission state of the driving shaft 19 is changed to a non-transmission state, and the pickup roller 2 is changed to a state where the pickup roller 2 is not rotated.

The operation will be described below with reference to the state ST9 in FIG. 3. When the image forming operation with respect to the first line from the last line on the preceding sheet 1-A is ended, the sheet conveyance roller 5 is rotated by a predetermined amount, so that the subsequent sheet 1-B is head-aligned while the state where the subsequent sheet 1-B is overlapped on the preceding sheet 1-A is maintained. At this time, the preceding sheet 1-A and the subsequent sheet 1-B are conveyed in such a manner that the last line on the preceding sheet 1-A and the first line on the subsequent sheet 1-B simultaneously face the recording head 7. When the subsequent sheet 1-B is head-aligned, the sheet feeding motor 206 is switched to low speed driving. More specifically, the pickup roller 2 and the sheet feeding roller 3 are rotated at 7.6 inch/sec.

After the subsequent sheet 1-B is head-aligned, an image forming operation is performed, based on the recording data, on the last line on the preceding sheet 1-A and the first line on the subsequent sheet 1-B in the same scan by the recording head 7 (also referred to as "simultaneous recording"). Then, when the subsequent sheet 1-B is intermittently conveyed for the image forming operation, the preceding sheet 1-A is also intermittently conveyed and is eventually discharged to the sheet discharge tray 18 by the sheet discharge roller 9.

Thereafter, if there is recording data after the subsequent sheet 1-B, the operation is returned to the state ST4 in FIG. 2, and the third recording sheet is picked up and the operation up to the state ST9 in FIG. 3 is repeated. In this way, the recording speed is improved in the case of performing continuous recording on the plurality of recording sheets 1.

Processing Example

Figure 6:
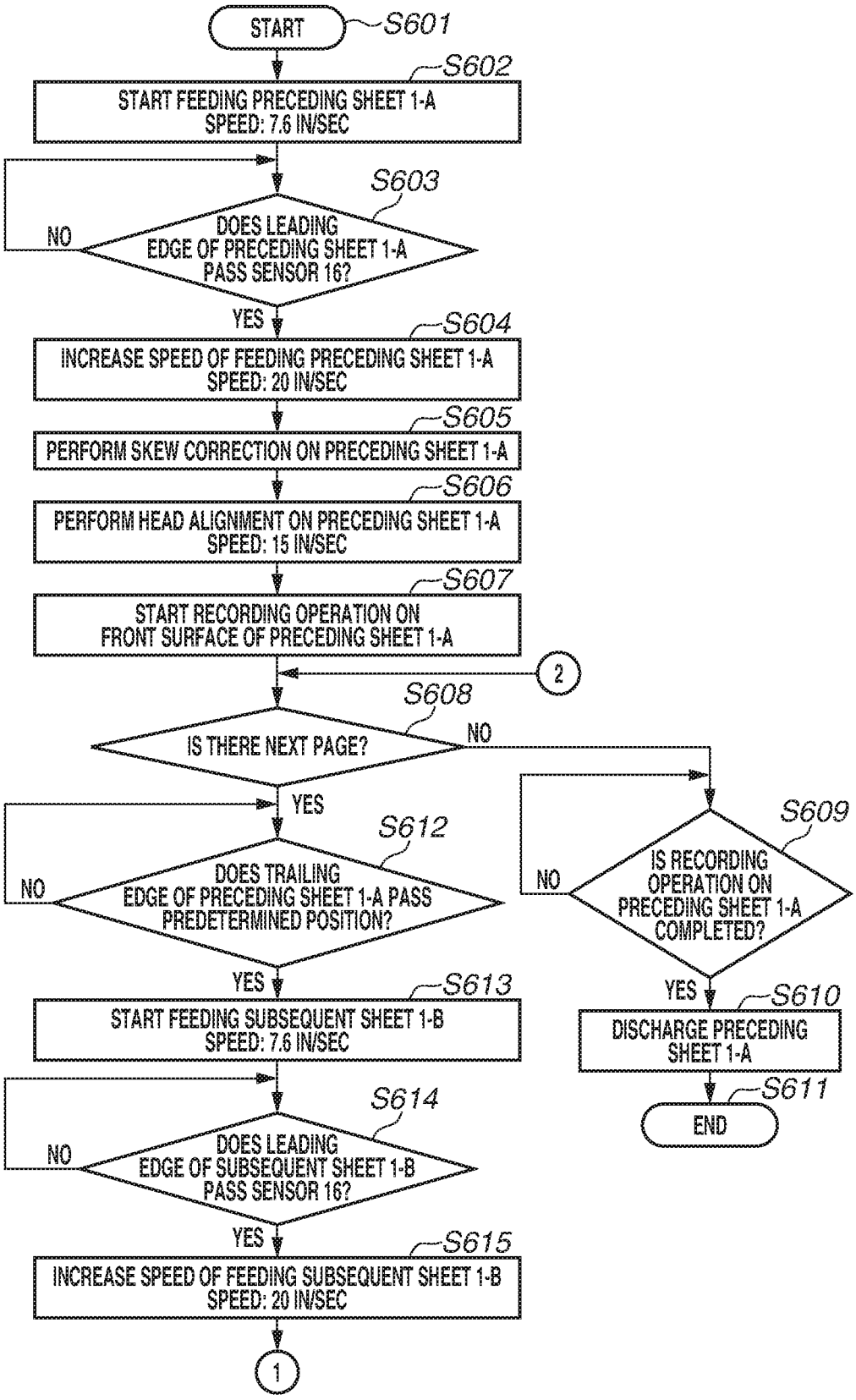
FIG. 6 is a flowchart illustrating processing performed by the recording apparatus according to the exemplary embodiment.
Figure 7:
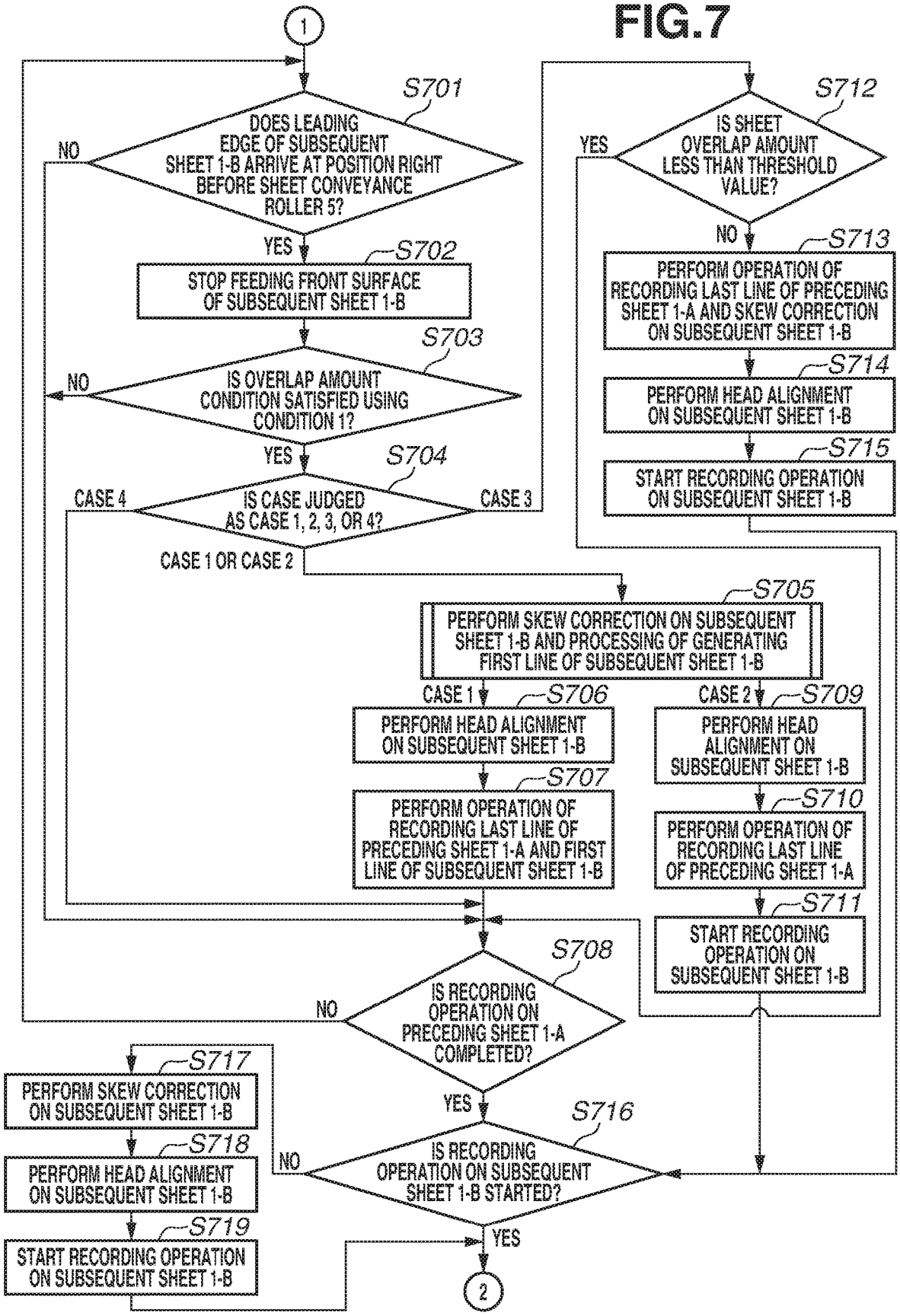
FIG. 7 is a flowchart illustrating processing performed by the recording apparatus according to the exemplary embodiment.

Processing performed by the MPU 201 to implement the operation illustrated in FIGS. 1 to 3 will be described below according to the flow of the operation illustrated in FIGS. 1 to 3. FIGS. 6 and 7 are flowcharts illustrating an example of the processing performed by the MPU 201 and illustrate an example of control performed by the recording apparatus 100.

In step S601 of FIG. 6, if recording data is transmitted from the host computer 214 via the I/F unit 213, the MPU 201 starts the control illustrated in the flowchart.

In step S602, an operation of feeding the preceding sheet 1-A is started. More specifically, the sheet feeding motor 206 is driven at low speed. The pickup roller 2 is rotated at 7.6 inch/sec. The pickup roller 2 picks up the preceding sheet 1-A, and the sheet feeding roller 3 feeds the preceding sheet 1-A toward the recording head 7.

In step S603, as illustrated in the state ST1 in FIG. 1, the sheet detection sensor 16 detects the leading edge of the preceding sheet 1-A. If the sheet detection sensor 16 detects the leading edge of the preceding sheet 1-A (YES in step S603), then in step S604, the sheet feeding motor 206 is switched to high-speed driving. More specifically, the pickup roller 2 and the sheet feeding roller 3 are rotated at 20 inch/sec.

In step S605, the rotation amount of the sheet feeding roller 3 after the leading edge of the preceding sheet 1-A is detected by the sheet detection sensor 16 is controlled to thereby perform the skew correction operation on the preceding sheet 1-A by causing the leading edge of the preceding sheet 1-A to bump into the sheet conveyance nip portion, as illustrated in the state ST2 in FIG. 1. When the skew correction operation on the preceding sheet 1-A is ended, the driving of the sheet feeding motor 206 is stopped. Further, the driving force transmission state of the driving shaft 19 is changed to the non-transmission state.

If the recording data is transmitted from the host computer 214, then in step S606, the preceding sheet 1-A is head-aligned based on the recording data. The MPU 201 controls the rotation amount of the sheet conveyance motor 205 via the sheet conveyance motor driver 209. The sheet conveyance roller 5 is rotated at 15 inch/sec.

Then, the preceding sheet 1-A is conveyed, based on the recording data, to a recording start position using the position of the sheet conveyance roller 5 as a reference.

In step S607, the recording head 7 discharges ink to the preceding sheet 1-A to thereby start an image forming operation, as illustrated in the state ST3 in FIG. 1. More specifically, the sheet conveyance operation is performed by controlling the rotation amount of the sheet conveyance motor 205 to intermittently convey the preceding sheet 1-A by the sheet conveyance roller 5 preceding sheet, and the carriage 10 is moved by controlling the rotation amount of the carriage motor 204 via the carriage motor driver 208. Further, the image forming operation (ink discharge operation) in which the recording head driver 207 causes the recording head 7 to discharge ink and the sheet conveyance operation in which the sheet conveyance roller 5 intermittently conveys the recording sheet by the predetermined amount are repeated based on the recording data rasterized in the RAM 203. This operation is performed to thereby perform the recording operation on the preceding sheet 1-A.

In step S608, whether there is recording data about a next page is judged. Information about whether there is recording data about a next page is transmitted from the host computer 214.

If there is no recording data about a next page (NO in step S608), the processing proceeds to step S609. In step S609, if the image forming operation on the preceding sheet 1-A is completed (YES in step S609), then in step S610, the preceding sheet 1-A is discharged, and then in step S611, the recording operation is ended.

On the other hand, in step S608, if there is recording data about a next page (YES in step S608), then in step S612, whether the trailing edge of the preceding sheet 1-A passes through the predetermined position is judged. If it is judged that the trailing edge of the preceding sheet 1-A passes through the predetermined position (YES in step S612), then in step S613, feeding of the subsequent sheet 1-B is started, as illustrated in the state ST4 in FIG. 2.

The position of the trailing edge of the preceding sheet 1-A can be calculated by adding the size of the recording sheet 1-A to the leading edge position. The leading edge position is defined by the distance from the sheet conveyance nip portion and is calculated from the rotation amount of the sheet conveyance roller 5 after the skew correction operation.

The predetermined position is a position at which the predetermined interval is formed between the preceding sheet 1-A and the subsequent sheet 1-B and is set based on the distance between the sheet feeding roller 3 and the sheet feeding tray 11. In the present exemplary embodiment, feeding of the subsequent sheet 1-B is started even if the margin amount of the trailing edge of the preceding sheet 1-A and the margin amount of the leading edge of the subsequent sheet 1-B are not known. Even in the case where feeding of the subsequent sheet 1-B is started without the margin amount known, the margin amount of the leading edge of the subsequent sheet 1-B is obtained and recording data about the first line is generated before recording of the last line on the preceding sheet 1-A is performed. Thus, the time length from when recording on the preceding sheet 1-A is completed to when recording on the subsequent sheet 1-B is started is reduced by the early start of the feeding of the subsequent sheet 1-B, and the throughput increases. Further, only recording data about three lines needs to be rasterized to the RAM 203, so that the amount of recording data rasterized in the RAM 203 can be reduced.

In step S613, the pickup roller 2 picks up the subsequent sheet 1-B, and the sheet feeding roller 3 feeds the subsequent sheet 1-B toward the recording head 7. The sheet feeding motor 206 is driven at low speed, and the pickup roller 2 and the sheet feeding roller 3 are rotated at 7.6 inch/sec. The subsequent sheet 1-B is conveyed while the distance between the sheets is maintained within a predetermined range, whereby the recording speed is improved.

In step S614, the sheet detection sensor 16 detects the leading edge of the subsequent sheet 1-B, as illustrated in the state ST5 in FIG. 2.

If the sheet detection sensor 16 detects the leading edge of the subsequent sheet 1-B (YES in step S614), then in step S615, the sheet feeding motor 206 is switched to high-speed driving, and the processing proceeds to step S701 in FIG. 7. The pickup roller 2 and the sheet feeding roller 3 are rotated at 20 inch/sec. The leading edge position of the subsequent sheet 1-B is controlled using the rotation amount of the sheet feeding motor 206 after the detection of the leading edge of the subsequent sheet 1-B by the sheet detection sensor 16.

In step S701 of FIG. 7, the subsequent sheet 1-B is conveyed in such a manner that the leading edge of the subsequent sheet 1-B is positioned before reaching the sheet conveyance nip portion by a predetermined amount. The preceding sheet 1-A is intermittently conveyed based on the recording data. The sheet feeding motor 206 is continuously driven at high speed so that the overlap state where the leading edge portion of the subsequent sheet 1-B overlaps on the trailing edge portion of the preceding sheet 1-A is formed, as illustrated in the state ST6 in FIG. 2.

If the leading edge of the subsequent sheet 1-B arrives at the position before reaching the sheet conveyance nip portion by the predetermined amount in the state where the overlap state is formed (YES in step S701), then in step S702, the driving of the sheet feeding motor 206 is stopped to stop feeding the subsequent sheet 1-B, and the processing proceeds to step S703.

In step S701, if the overlap state is not formed or if the leading edge of the subsequent sheet 1-B does not arrive at the position before reaching the sheet conveyance nip portion by the predetermined amount (NO in step S701), the processing proceeds to step S708. On the other hand, if the recording operation on the preceding sheet 1-A is not completed (NO in step S708), feeding of the subsequent sheet 1-B is continued.

In condition 1 used in step S703, whether a condition is satisfied is judged by judging the sheet overlap amount. In step S703, if the condition is satisfied (YES in step S703), the processing proceeds to step S704. On the other hand, if the condition is not satisfied (NO in step S703), the processing proceeds to step S708. In the case where the overlap state is formed, the subsequent sheet 1-B is positioned right before the sheet conveyance nip portion and the leading edge portion of the subsequent sheet 1-B is positioned so as to overlap the trailing edge portion of the preceding sheet 1-A, as illustrated in the state ST7 in FIG. 3, at the time of the judgement.

Figure 8:
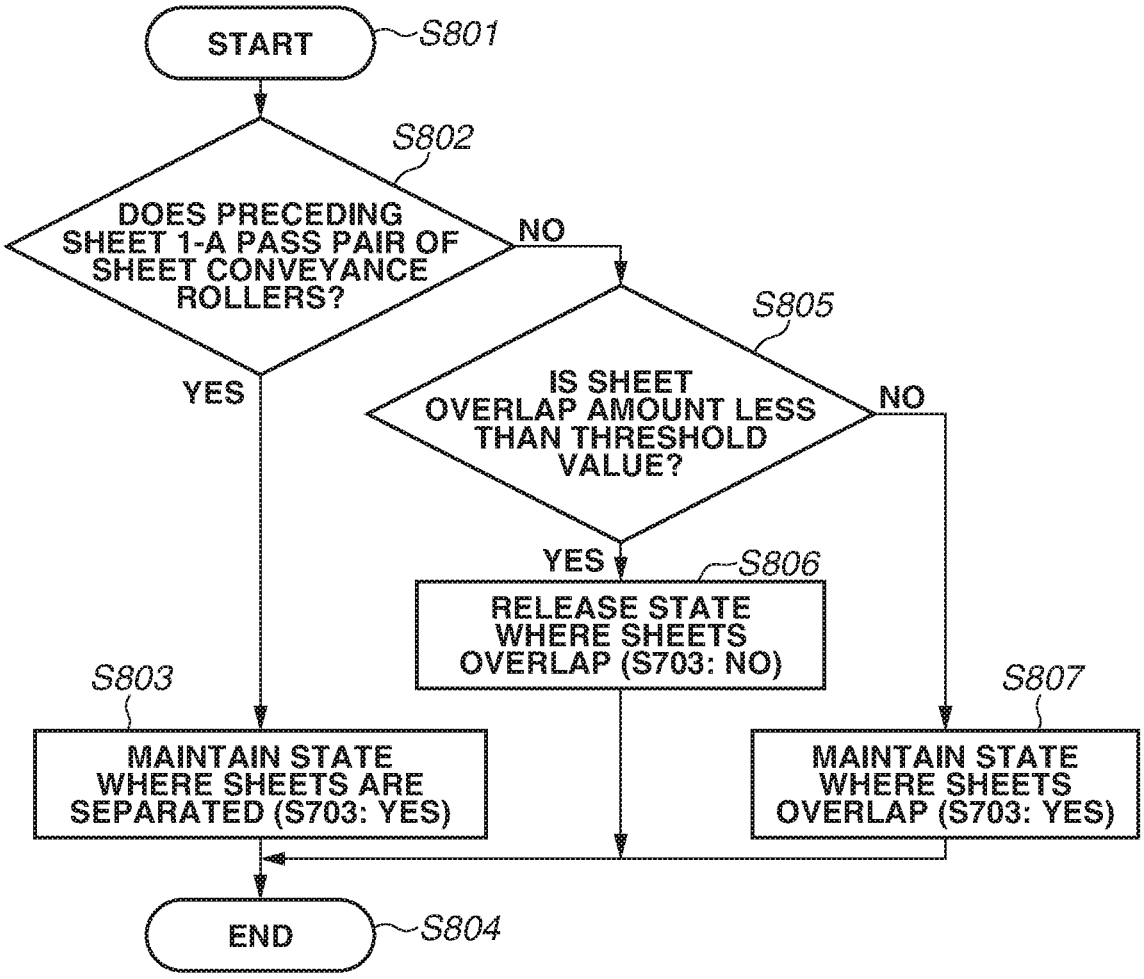
FIG. 8 is a flowchart illustrating processing of judging whether to cancel an overlap state of preceding and subsequent sheets in the processing performed by the recording apparatus according to the exemplary embodiment.
Figure 11:
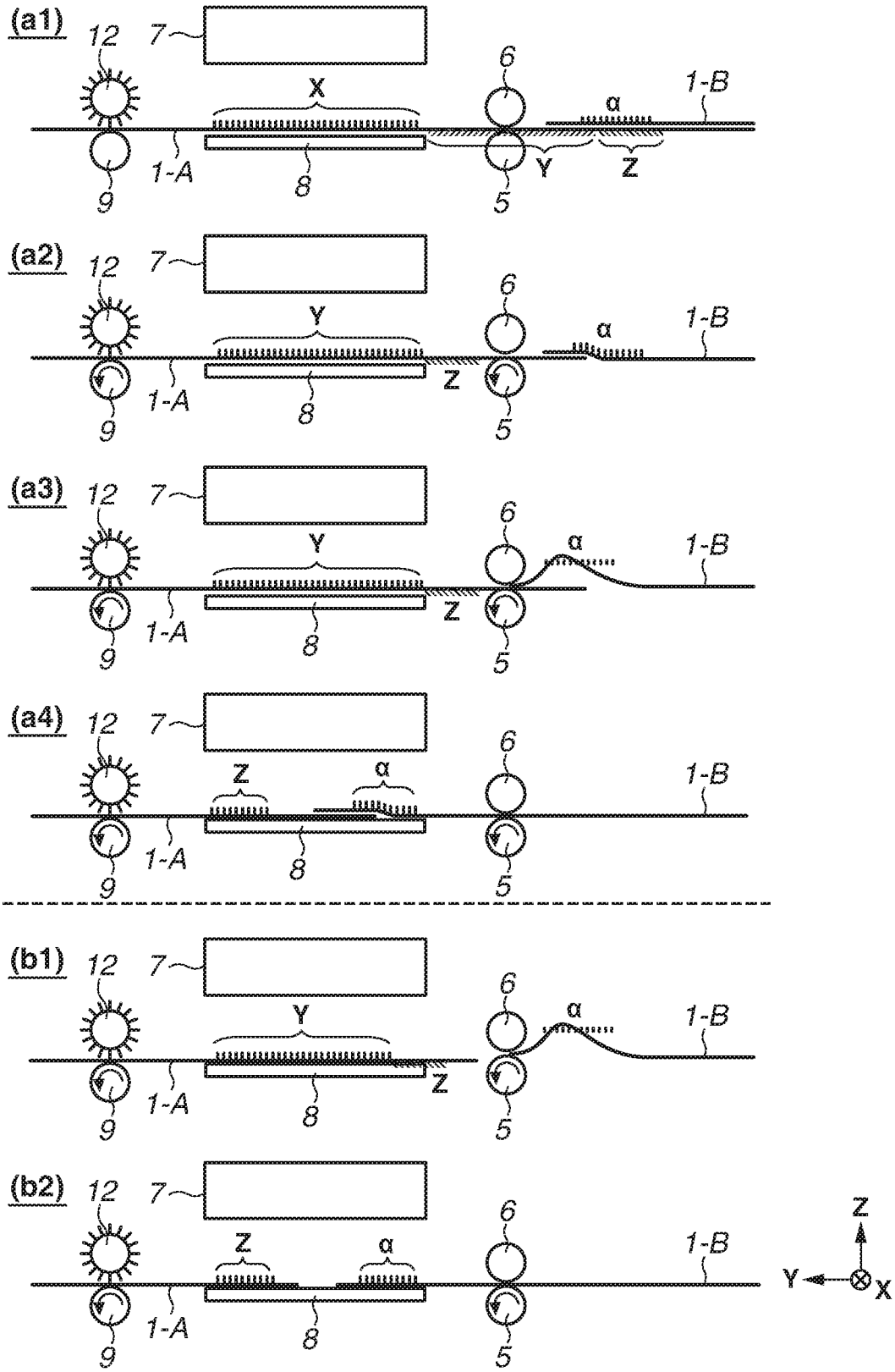
FIG. 11 illustrates an operation performed in a case of printing on preceding and subsequent sheets in a single scan by the recording apparatus according to the exemplary embodiment.
Figure 12:
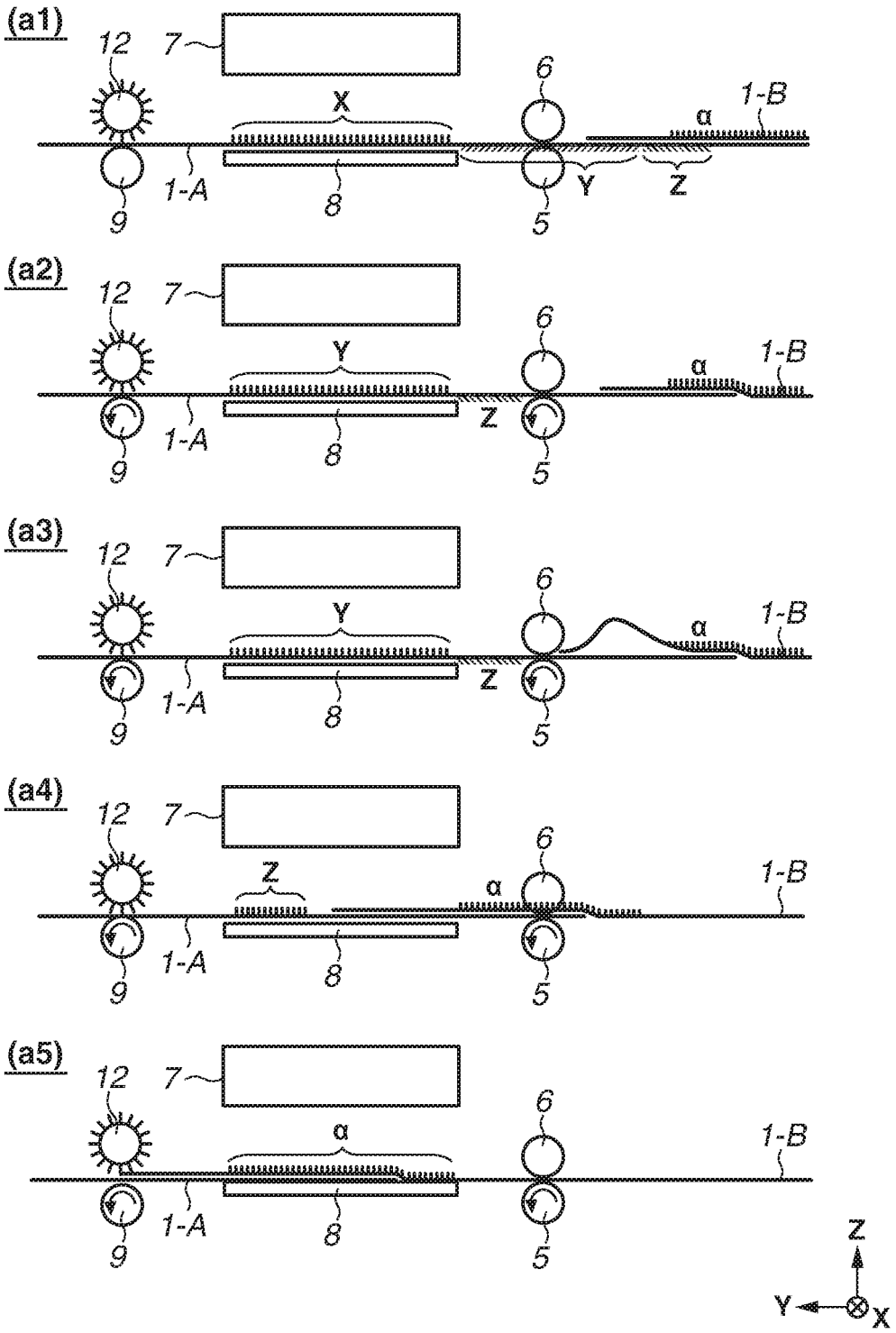
FIG. 12 illustrates an operation performed in a case of printing on preceding and subsequent sheets in different scans by the recording apparatus according to the exemplary embodiment.
Figure 13:
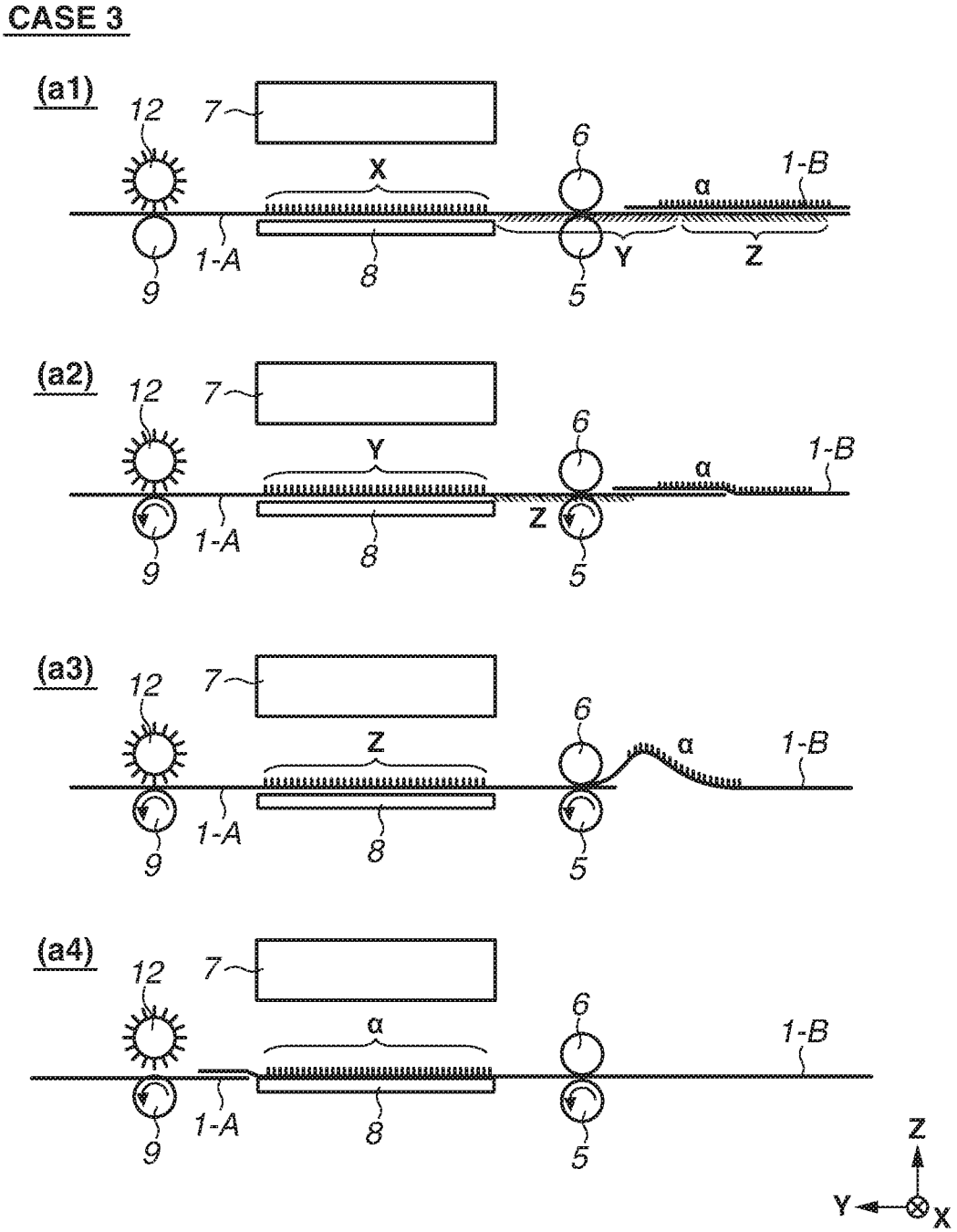
FIG. 13 illustrates an operation performed in a case of printing on preceding and subsequent sheets in different scans by the recording apparatus according to the exemplary embodiment.

Details of the judgment in step S703 in FIG. 7 will be described below with reference to FIG. 8, and the processing in step S703 and the subsequent steps will be described with further reference to FIGS. 11 to 13. FIGS. 11 to 13 are schematic diagrams illustrating a recording operation of the recording apparatus 100 and are cross-sectional views illustrating a cross-section of the same position as in FIG. 1, with a neighborhood area of the recording head 7 enlarged. In FIGS. 11 to 13, image regions X, Y, and Z are image regions to be formed on the preceding sheet 1-A. The image region X is an image region of the second line from the last line on the preceding sheet 1-A. The image region Y is an image region of the first line from the last line. The image region Z (sometimes, also refers to as last line Z) is an image region of the last line on the preceding sheet 1-A. Further, an image region a is an image region of the first line on the subsequent sheet 1-B, and FIGS. 11 to 13 illustrate from a state before the image regions are recorded.

<Judgement of Condition 1>

Details of the judgement in step S703 in FIG. 7 will be described below with reference to FIG. 8. FIG. 8 is a flowchart illustrating a process of judging whether to convey the preceding sheet 1-A and the subsequent sheet 1-B to an image forming position while maintaining the state of the sheets. If the sheets are to be conveyed while the state is maintained, it is judged that the condition is satisfied. On the other hand, if the sheets are not to be conveyed while the state is maintained, it is judged that the condition is not satisfied. The judgement is started from step S801 at the time of performing the image forming operation on the second line from the last line on the preceding sheet 1-A.

First, in step S802, whether the trailing edge of the preceding sheet 1-A passes through the sheet conveyance nip portion is judged. The position of the trailing edge of the preceding sheet 1-A is determined as follows. The position of the leading edge of the preceding sheet 1-A is determined based on a rotation amount of the sheet conveyance roller 5 after the skew correction operation is performed on the preceding sheet 1-A. A position located upstream in the sheet conveyance direction from the determined position of the leading edge by the size of the preceding sheet 1-A is determined as the position of the trailing edge of the preceding sheet 1-A. Then, whether the determined position of the trailing edge of the preceding sheet 1-A passes through the sheet conveyance nip portion is judged.

If it passes through the sheet conveyance nip portion (YES in step S802), the processing proceeds to step S803. In the case where the processing proceeds to step S803, the preceding sheet 1-A and the subsequent sheet 1-B are not in the overlap state but in a separated state where the trailing edge of the preceding sheet 1-A and the leading edge of the subsequent sheet 1-B are separated with a space therebetween. The overlap amount decreases as the recording operation on the preceding sheet 1-A is performed. Thus, although the preceding sheet 1-A and the subsequent sheet 1-B are in the overlap state before the trailing edge of the preceding sheet 1-A passes through the sheet conveyance nip portion, the preceding sheet 1-A and the subsequent sheet 1-B may be separated after passing through a nip position as the recording operation on the preceding sheet 1-A is performed. If the preceding sheet 1-A and the subsequent sheet 1-B are in the separated state, it is judged that the separated state is to be maintained and that the condition is satisfied. Then, in step S804, the process is ended.

In step S802, if the trailing edge of the preceding sheet 1-A does not pass through the sheet conveyance nip portion (NO in step S802), the processing proceeds to step S805. In step S805, the trailing edge of the preceding sheet 1-A and the leading edge of the subsequent sheet 1-B are in the overlap state, and whether an overlap amount is less than a predetermined threshold value is judged. The distance between the position of the trailing edge of the preceding sheet 1-A and the position of the leading edge of the subsequent sheet 1-B obtained is calculated as the overlap amount. The position of the trailing edge of the preceding sheet 1-A is the same as the position of the trailing edge used previously in step S802. Further, the position of the leading edge of the subsequent sheet 1-B can be calculated from a rotated amount of the sheet feeding motor 206 after the leading edge of the subsequent sheet 1-B is detected by the sheet detection sensor 16.

If it is judged that the overlap amount is less than the threshold value (YES in step S805), the processing proceeds to step S806, and the overlap state is cancelled and it is judged that the condition is not satisfied. Then, in step S804, the process is ended. In the case where the overlap amount is less than the threshold value, the sheet conveyance and the recording operation may become unstable, so that the continuous overlapping sheet feeding operation is not performed to thereby prevent a problem in conveyance of the subsequent sheet 1-B.

In step S805, if it is judged that the overlap amount is larger than the threshold value (NO in step S805), the processing proceeds to step S807. At this time, the conveyed sheet is in a state a1 illustrated in FIG. 11, 12, or 13. It is judged that the overlap state of the trailing edge of the preceding sheet 1-A and the leading edge of the subsequent sheet 1-B maintained and that the condition is satisfied, and in step S804, the process is ended.

Next, if the processing proceeds from step S703 to step S704 as a result of the judgment in step S703, then in step S704, condition 2 is judged. In this judgement, whether the case is Case 1, 2, 3, or 4 is judged based on the relationship between the image regions and the sheet conveyance state. Details of the judgement will be described below.

<Judgement of Condition 2>

Figure 9:
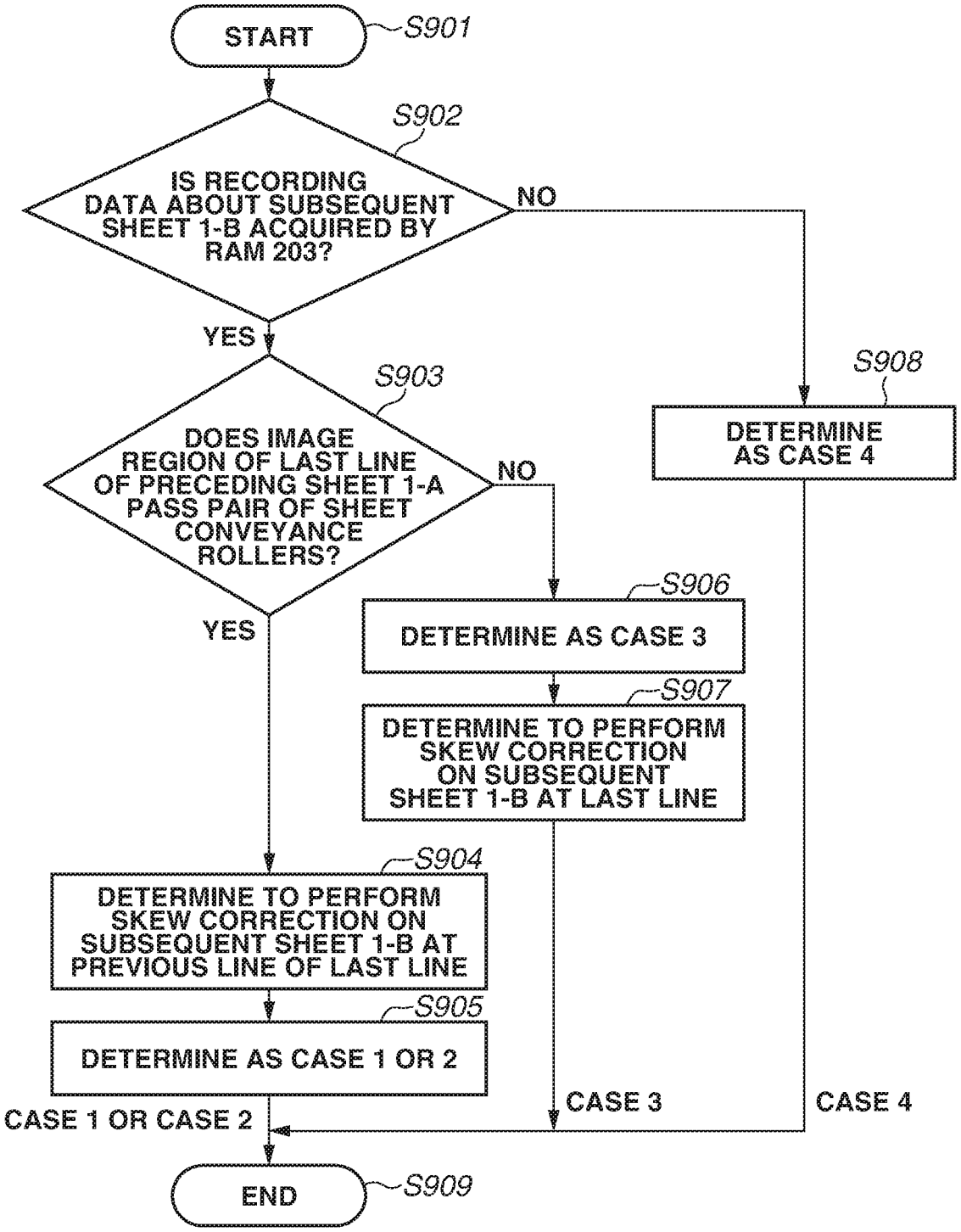
FIG. 9 is a flowchart illustrating processing of judging whether image forming on preceding and subsequent sheets is executable in the same scan by a recording head in the processing performed by the recording apparatus according to the exemplary embodiment.

Details of the judgement in step S704 in FIG. 7 will be described below with reference to FIG. 9. FIG. 9 is a flowchart illustrating a simultaneous recording judgement process in which whether to execute an image forming operation on the last line on the preceding sheet 1-A and the first line on the subsequent sheet 1-B in the same scan by the recording head 7 is judged, and whether the case is Case 1, 2, 3, or 4 is judged thereby.

The processing of judgement from step S901 to step S909 is started at the time of performing the image forming operation on the first line from the last line on the preceding sheet 1-A. As a result of the judgment in the flowchart in FIG. 9, it is judged as one of Cases 1 to 4.

First, in step S902, whether recording data about the subsequent sheet 1-B is written in the RAM 203 is judged to check whether the recording apparatus 100 acquires the recording data about the subsequent sheet 1-B. If the recording data is acquired (YES in step S902), the processing proceeds to step S903. On the other hand, if the recording data is not acquired (NO in step S902), the processing proceeds to step S908, and it is determined that the case is Case 4 and the operation of recording the first line on the subsequent sheet 1-B is not performed simultaneously with the recording of the last line on the preceding sheet 1-A.

In step S902, if it is judged that the recording data is acquired (YES in step S902), the processing proceeds to step S903. In step S903, whether the position to be the trailing edge of the last line to be recorded on the preceding sheet 1-A passes through the nip position formed by the sheet conveyance roller 5 and the pinch roller 6 is judged. The position of the trailing edge of the last line on the preceding sheet 1-A, i.e., the position of the trailing edge of the image to be recorded, can be calculated from the position of the leading edge of the preceding sheet 1-A and the distance from the position of the leading edge of the preceding sheet 1-A to the trailing edge of the image to be formed on the preceding sheet 1-A in the sheet conveyance direction.

The position of the leading edge of the preceding sheet 1-A can be calculated from a rotation amount of the sheet conveyance roller 5 during the period between the skew correction on the preceding sheet 1-A and step S903. Next, how to calculate the distance from the position of the leading edge of the preceding sheet 1-A to the trailing edge of the image will be described below.

First, the position of the leading edge of the image on the preceding sheet 1-A is identified before the skew correction is performed on the preceding sheet 1-A in step S605 in FIG. 6. A region (hereinafter, "recordable region") where the recording apparatus 100 can perform recording on the preceding sheet 1-A is determined. The recording data written in the RAM 203 contains information about a recording region in a page as, for example, margin amount information, and the recordable region can be determined based on the information. A length corresponding to the margin amount is added to the position of the leading edge of the preceding sheet 1-A to thereby identify the leading edge of the recordable region, and the identified leading edge is set as the leading edge position of the recordable region. The leading edge position is defined by the distance from the sheet conveyance nip portion.

Next, image data to be recorded on the preceding sheet 1-A is read from the RAM 203. The distance from the leading edge of the recordable region to the leading edge of the image to be formed on the preceding sheet 1-A is identified based on the read image data. The identified distance is added to a previously-set upper margin to thereby obtain the leading edge position of the image on the preceding sheet 1-A in the sheet conveyance direction.

Thereafter, in step S605, skew correction is performed on the preceding sheet 1-A, and then in step S606, head alignment is performed on the preceding sheet 1-A.

Then, in step S607, recording on the preceding sheet 1-A is started. The position of the leading edge of the preceding sheet 1-A is calculated from a rotation amount of the sheet conveyance roller 5 since the skew correction.

The calculated distance from the leading edge of the preceding sheet 1-A to the leading edge of the image to be formed on the preceding sheet 1-A is stored in the RAM 203. At this time point, recording data corresponding to several scans is written in the RAM 203, and thereafter, image data to be recorded on the preceding sheet 1-A is further sequentially written into the RAM 203. The distance of the image to be recorded based on the written recording data in the sheet conveyance direction is added to the distance from the leading edge of the preceding sheet 1-A to the leading edge position of the image to be formed on the preceding sheet 1-A, which is already stored in the RAM 203. By adding the distance, the position of the trailing edge of the image to be recorded on the preceding sheet 1-A in the preceding sheet 1-A is identified.

With the above-described processing, the position of the trailing edge of the image to be recorded on the preceding sheet 1-A, i.e., the trailing edge of the last line on the preceding sheet 1-A is calculated from the position of the leading edge of the preceding sheet 1-A, which is calculated from the rotation amount of the sheet conveyance roller 5, and the position of the trailing edge of the image in the preceding sheet 1-A.

In step S903, whether the calculated position of the trailing edge of the last line on the preceding sheet 1-A is located upstream, in the sheet conveyance direction, of a pair of sheet conveyance rollers formed by the sheet conveyance roller 5 and the pinch roller 6 is judged. If the calculated position is located downstream, it is judged that the image region of the last line on the preceding sheet 1-A does not pass through the pair of sheet conveyance rollers. In this case (NO in step S903), the processing proceeds to step S906. In step S906, it is determined that the case is Case 3 and the operation of recording the first line on the subsequent sheet 1-B is not performed simultaneously with the recording of the last line on the preceding sheet 1-A. At this time, the conveyed sheet is in a state a2 illustrated in FIG. 13. The image region Z to be formed is at the nip position formed by the sheet conveyance roller 5 and the pinch roller 6, and the trailing edge of the image region Z does not pass through the nip position. In a case where skew correction is performed and the preceding sheet 1-A and the subsequent sheet 1-B are conveyed, the preceding sheet 1-A and the subsequent sheet 1-B are both conveyed by the sheet conveyance roller 5, so that the overlap amount formed at the time of performing the skew correction is maintained, and recording is performed. Thus, if skew correction is performed in this state and the subsequent sheet 1-B is overlapped on the preceding sheet 1-A, the subsequent sheet 1-B is overlapped on a region of the preceding sheet 1-A on which the image region Z is to be formed, so that the image region Z cannot be formed.

Thus, in step S907, it is determined to perform skew correction on the subsequent sheet 1-B while recording of the image region Z of the last line on the preceding sheet 1-A is performed. In this way, the overlap state is formed after the image region Z and the subsequent sheet 1-B are not overlapped. The overlap position is changed depending on the determination in step S907, so that the overlap amount is smaller in the state a2 in FIG. 13 than in a state a2 in FIG. 11 or 12 described below.

On the other hand, in step S903, if the position of the trailing edge of the last line on the preceding sheet 1-A is located before the pair of sheet conveyance rollers formed by the sheet conveyance roller 5 and the pinch roller 6 in the sheet conveyance direction, it is judged that the image region of the last line on the preceding sheet 1-A passes through the pair of sheet conveyance rollers. In this case (YES in step S903), the processing proceeds to step S904. At this time, the conveyed sheets are in the state a2 in FIG. 11 or 12. Since the trailing edge of the image region Z passes through the nip position formed by the pair of rollers, even if the overlap state is formed, the subsequent sheet 1-B is not likely to be overlapped on the image region Z.

Thus, in step S904, it is determined to perform skew correction on the subsequent sheet 1-B while the image forming operation on the first line from the last line on the preceding sheet 1-A is performed. Then, in step S905, it is determined to judge that the case is Case 1 or 2, and in step S909, the judgement of condition 2 is ended.

In the present exemplary embodiment, the subsequent sheet 1-B and the preceding sheet 1-A are conveyed in the overlap state as much as possible, and whether to perform skew correction is judged using condition 1 in step S703 and condition 2 in step S704 to thereby determine whether to maintain the overlap state. With this operation, the overlap width can be changed after the image region is identified after sheet feeding is started, and this contributes to reduction of the time consumed before the start of feeding of preceding and subsequent sheets. Further, even if, for example, the sheet feeding situation of the subsequent sheet 1-B is changed after the start of feeding of the subsequent sheet 1-B, it is possible to adapt to the change in the sheet feeding situation by judging whether to perform skew correction. Further, in step S905, whether an image forming operation on the preceding and subsequent sheets is to be performed in the same scan is judged. The image forming operation on the two sheets is performed in the same scan, so that the time from the start of recording of the preceding sheet to the end of recording of the subsequent sheet is reduced.

The processing performed after the judgement in step S704 will be described below with reference to FIG. 7. In step S704, if the case is judged as Case 1 or 2, the processing proceeds to step S705. If the case is judged as Case 3, the processing proceeds to step S712. If the case is judged as Case 4, the processing proceeds to step S708.

In step S705, skew correction on the subsequent sheet 1-B and generation of the first line on the subsequent sheet 1-B are performed. In the generation of the first line on the subsequent sheet 1-B, recording data about the first line on the subsequent sheet 1-B is generated, and whether the case is Case 1 or 2 is judged. This will be described below with reference to FIG. 10. Hereinafter, the term "distance" refers to a distance in the sheet conveyance direction.

First, in step S201, if an instruction to start processing is received, then in step S202, a recordable region of the subsequent sheet 1-B on which the recording apparatus 100 can perform recording is determined. The recording data in the RAM 203 that is confirmed to be acquired in step S902 in FIG. 9 contains information about a recording region in a page as, for example, margin amount information, and the recordable region can be determined based on the information. In this way, the leading edge, i.e., upper margin, of the recordable region can be identified, so that in step S203, the distance to the position of the identified leading edge of the recordable region is determined using the leading edge of the subsequent sheet 1-B as a reference. The position of the leading edge of the subsequent sheet 1-B is at the sheet conveyance nip portion, which is the leading edge position after skew correction is performed, and the leading edge position of the recordable region is defined by the distance from the sheet conveyance nip portion.

Next, in step S204, image data to be recorded on the subsequent sheet 1-B is read from the RAM 203.

Then, in step S205, the distance from the leading edge of the recordable region of the sheet to the leading edge of the image to be formed on the sheet in the sheet conveyance direction is identified based on the read image data. The identified distance is added to the position of the leading edge of the recordable region that is set in step S203, whereby the leading edge position of the image on the subsequent sheet 1-B in the sheet conveyance direction is obtained.

In step S206, the leading edge position obtained in step S205 is updated to the leading edge position of the image based on the recording data, and the processing proceeds to step S207.

In step S207, the distance from the leading edge of the last line on the preceding sheet 1-A to the leading edge of the image of the first line on the subsequent sheet 1-B is calculated.

Next, in step S208, whether the distance from the leading edge of the last line on the preceding sheet 1-A to the first line on the subsequent sheet 1-B is longer than the recordable width of the recording head 7 is judged. In this way, whether the first line on the subsequent sheet 1-B is within the recordable width of the recording head 7 (range of the discharge openings in Y-direction) at the time of recording the last line on the preceding sheet 1-A is determined, so that whether the sheets are recordable in the same scan can be determined. If the distance is shorter than the recordable width (NO in step S208), the processing proceeds to step S209 because recording data about the preceding sheet 1-A and recording data about the subsequent sheet 1-B can be recorded in the same scan by the recording head 7.

In step S209, the case is judged as Case 1, and recording data about the first line on the subsequent sheet 1-B is generated in such a manner that the distance from the leading edge of the last line on the preceding sheet 1-A to the trailing edge of the first line on the subsequent sheet 1-B is within the recordable width of the recording head 7. The distance from the downstream-side leading edge of the last line Z on the preceding sheet 1-A, which is on the downstream side in the Y-direction, to the downstream-side leading edge of the image region a including the first line on the subsequent sheet 1-B, which is on the downstream side in the Y-direction, in the state a2 in FIG. 11 is shorter than the recordable width of the recording head 7, so that the case is judged as Case 1.

On the other hand, if the distance is longer than the recordable width (YES in step S208), the processing proceeds to step S210. In step S210, because recording data about the preceding sheet 1-A and recording data about the subsequent sheet 1-B are not recordable in the same scan performed by the recording head 7, the case is judged as Case 2. Then, recording data about the first line on the subsequent sheet 1-B is generated in such a manner that the distance from the leading edge of the last line on the preceding sheet 1-A to the first line on the subsequent sheet 1-B is within the recordable width of the recording head 7. The distance from the downstream-side leading edge of the last line Z on the preceding sheet 1-A, which is located on the downstream side in the Y-direction, to the downstream-side leading edge of the image region a including the first line on the subsequent sheet 1-B, which is located on the downstream side in the Y-direction, is longer than the recordable width of the recording head 7 in the state a2 in FIG. 12, and the case is judged as Case 2.

The case is determined as Case 1 or 2 and recording data about the first line on the subsequent sheet 1-B is generated as described above.

<Case 1>

In step S705, the case is judged as Case 1, and the leading edge of the subsequent sheet 1-B is caused to bump into the nip position to perform skew correction on the subsequent sheet 1-B, as illustrated in the state ST8 in FIG. 3 and the states a3 and b1 in FIG. 11. Further, the state of transmission of driving force to the driving shaft 19 is changed from the transmission state to the non-transmission state. Then, in step S706, the subsequent sheet 1-B is head-aligned so that the preceding sheet 1-A and the subsequent sheet 1-B are conveyed in such a manner that the last line Z of the preceding sheet 1-A and the first line a on the subsequent sheet 1-B simultaneously face the recording head 7.

Then, in step S707, a recording operation for image forming of the last line Z on the preceding sheet 1-A and image forming of the first line a on the subsequent sheet 1-B is performed, as illustrated in the state ST9 in FIG. 3 or the state a4 or b2 in FIG. 11. The recording head 7 performs, in the same scan, image forming of the last line on the preceding sheet 1-A and the first line on the subsequent sheet 1-B in FIG. 11. In the present exemplary embodiment, the image region of the first line on the subsequent sheet 1-B is formed in such a manner that image forming of the last line on the preceding sheet 1-A and image forming of the first line on the subsequent sheet 1-B are performed in the same scan by the recording head 7.

Thereafter, in step S708, the image forming operation on the preceding sheet 1-A is completed, and if the subsequent sheet 1-B is intermittently conveyed for an image forming operation, the preceding sheet 1-A is also intermittently conveyed, and the preceding sheet 1-A is discharged to the sheet discharge tray 18 by the sheet discharge roller 9.

In the case where the processing proceeds to step S708 from step S707, the recording operation on the preceding sheet 1-A is already completed in step S708, and the processing proceeds to step S716.

In step S716, the recording operation on the subsequent sheet 1-B is already started. Thus, the processing proceeds to "2" (circled) to return to step S608 in FIG. 6. Then, step S608 and the subsequent steps are executed on the subsequent sheet 1-B as the preceding sheet 1-A.

<Case 2>

In step S705, the case is judged as Case 2 and, as illustrated in the state a3 in FIG. 12, skew correction is performed on the subsequent sheet 1-B while recording of the first line from the last line on the preceding sheet 1-A is performed.

Then, in step S709, the subsequent sheet 1-B is head-aligned, and the last line Z on the preceding sheet 1-A is conveyed to the position opposing the recording head 7.

Then, in step S710, as illustrated in the state a4 in FIG. 12, a recording operation is performed until image forming of the last line on the preceding sheet 1-A is completed. If the recording operation on the preceding sheet 1-A is completed and the subsequent sheet 1-B is intermittently conveyed for the image forming operation, the preceding sheet 1-A is also intermittently conveyed and is eventually discharged to the sheet discharge tray 18 by the sheet discharge roller 9. Then, the processing proceeds to step S711, and a recording operation on the subsequent sheet 1-B is started. First, image forming of the image region a of the first line on the subsequent sheet 1-B is performed, as illustrated in the state a5 in FIG. 12.

In step S716, the recording operation on the subsequent sheet 1-B is already started. Thus, the processing proceeds to "2" (circled) to return to step S608 in FIG. 6. Then, step S608 and the subsequent steps are executed on the subsequent sheet 1-B as the preceding sheet 1-A.

<Case 3>

In step S704, if the case is judged as Case 3, then in step S712, whether the overlap amount of the sheets is less than the threshold value is judged. The overlap amount to be judged is an overlap amount after the last line on the preceding sheet 1-A passes through the pair of sheet conveyance rollers. If the overlap amount is less than the threshold value (YES in step S712), the processing proceeds to step S708. In step S708, the recording operation on the preceding sheet 1-A is not completed, so that the processing returns to step S701.

Figure 10:
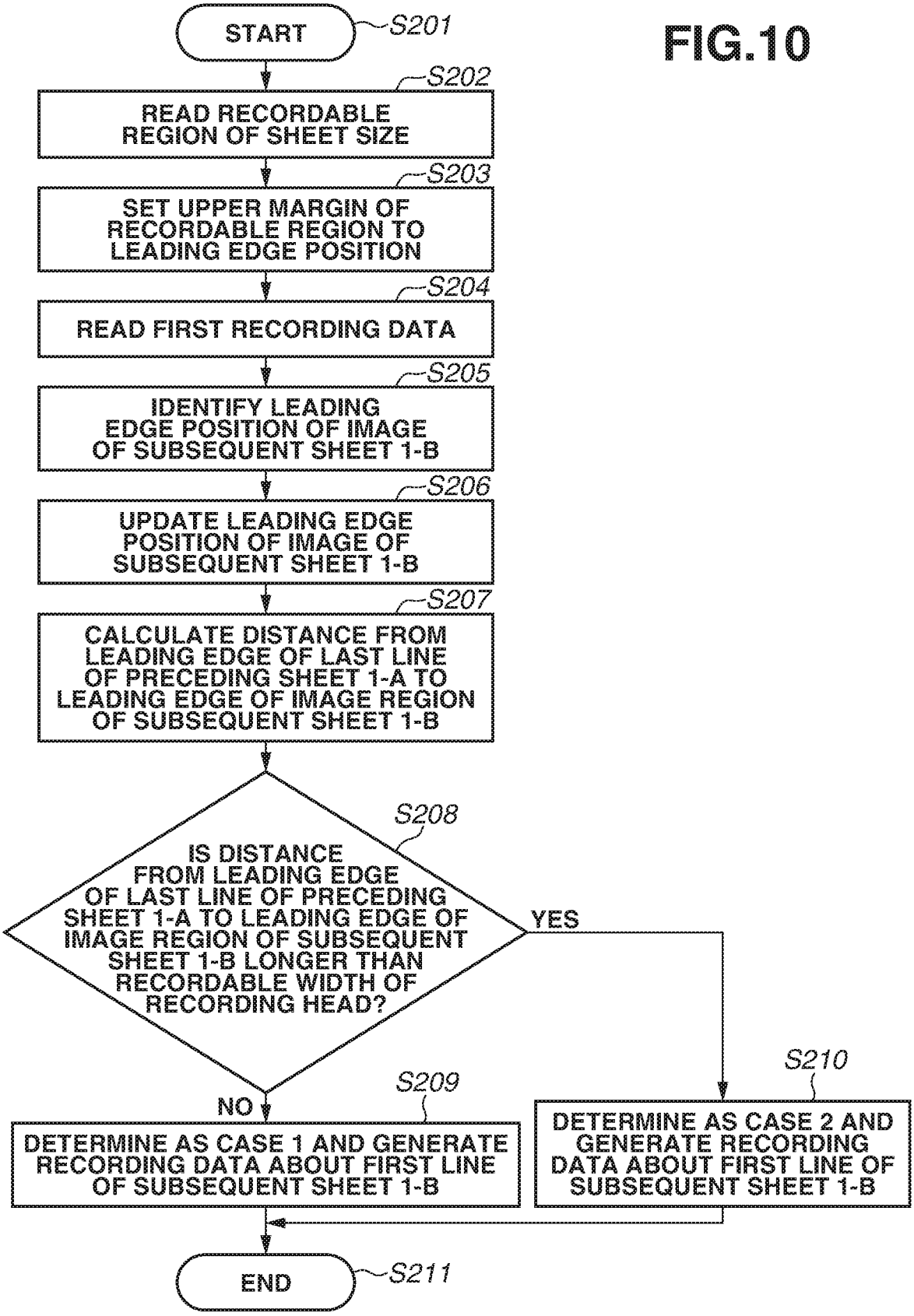
FIG. 10 is a flowchart illustrating processing of generating recording data about a first line on the subsequent sheet in the processing performed by the recording apparatus according to the exemplary embodiment.

On the other hand, if the overlap amount is larger than threshold value (NO in step S712), then in step S713, recording operation of the last line Z on the preceding sheet 1-A is performed and skew correction is performed on the subsequent sheet 1-B, as illustrated in the state a3 in FIG. 13. In Case 3, images on the preceding sheet 1-A and the subsequent sheet 1-B are not recorded in the same scan by the recording head 7, so that the distance from the leading edge of the last line on the preceding sheet 1-A to the leading edge of the image of the first line on the subsequent sheet 1-B is not calculated. Similar processing performed in steps S202 to S206 in FIG. 10 are executed to determine the leading edge position of the image on the subsequent sheet 1-B, and recording data about the first line on the subsequent sheet 1-B is generated in such a manner that the first line on the subsequent sheet 1-B falls within the recordable width of the recording head 7.

Then, in step S714, the subsequent sheet 1-B is head-aligned, and the preceding sheet 1-A is conveyed and is eventually discharged to the sheet discharge tray 18 by the sheet discharge roller 9.

If the recording region of the subsequent sheet 1-B is conveyed to the position opposing the recording head 7, then in step S715, a recording operation on the subsequent sheet 1-B is started. First, image forming of the image region a of the first line on the subsequent sheet 1-B is performed, as illustrated in the state a4 in FIG. 13.

In step S716, the recording operation on the subsequent sheet 1-B is already started. Thus, the processing proceeds to "2" (circled) to return to step S608 in FIG. 6. Then, step S608 and the subsequent steps are executed on the subsequent sheet 1-B as the preceding sheet 1-A.

<Case 4>

In the case where the overlap state is not formed before the image forming operation on the preceding sheet 1-A is completed in step S708 or the case is judged as Case 4 in step S704, the image forming operation on the subsequent sheet 1-B is not started in step S716. Thus, after the image forming operation on the preceding sheet 1-A is completed, the leading edge of the subsequent sheet 1-B is caused to bump into the sheet conveyance nip portion to perform skew correction on the subsequent sheet 1-B in step S718.

In step S718, the subsequent sheet 1-B is head-aligned based on the recording data, and in step S719, an image forming operation on the subsequent sheet 1-B is started. Then, the processing proceeds to "2" (circled) to return to step S608 in FIG. 6. Then, step S608 and the subsequent steps are executed on the subsequent sheet 1-B as the preceding sheet 1-A.

Recording is continuously performed on a plurality of recording sheets 1 as described above, and the recording speed can be improved in the case of continuously recording on the plurality of sheets 1.

The main exemplary embodiment of the disclosure is the states a2 and b2 in FIG. 11. The image region Z of the last line on the preceding sheet 1-A and the image region a of the first line on the subsequent sheet 1-B simultaneously face the recording head 7, and recording on the image region Z and recording on the image region a are performed in the same scan by the recording head 7. The throughput at this time is the highest throughput in the present exemplary embodiment.

OTHER EMBODIMENTS

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the exemplary embodiments described above, a decrease in recording throughput is prevented by starting feeding preceding and subsequent sheets even if the amount of margin of a trailing edge of the preceding sheet and the amount of margin of a leading edge of the subsequent sheet are not known, and performing simultaneous recording on the preceding and subsequent sheets in a case where simultaneous recording can be executed after the subsequent sheet is fed.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-123752, filed Jun. 28, 2018, which is hereby incorporated by reference herein in its entirety.

What is claimed is:

1. A recording apparatus comprising:

a recording unit including a plurality of recording elements arranged in a predetermined direction and configured to record an image on a sheet located at a recording position based on the recording data while performing scanning in a direction intersecting with the predetermined direction;

a sheet conveyance mechanism configured to convey sheet;

one or more processors;

one or more computer-readable storage media coupled to the one or more processors, the one or more computer-readable storage media storing instructions that, when executed by the one or more processors, cause the one or more processors to perform operations comprising:

generating recording data to be used for recording by processing input data;

acquiring information about an overlap amount between the preceding sheet and the subsequent sheet when the preceding sheet and the subsequent sheet are conveyed to the recording position, based on a position of a trailing edge of an image of a last line on the preceding sheet in the predetermined direction determined based on the recording data;

causing the sheet conveyance mechanism to form an overlap state where a trailing edge portion of a preceding sheet and a leading edge portion of a subsequent sheet overlap, and to convey the preceding sheet and the subsequent sheet so as to convey the preceding sheet and the subsequent sheet in the overlap state to the recording position;

acquiring distance information about a distance between a leading edge of an image of a last line on the preceding sheet and a leading edge of an image on the subsequent sheet in the predetermined direction when the preceding sheet and the subsequent sheet are conveyed to the recording position based on the acquired overlap amount and the recording data;

wherein the sheet conveyance unit starts conveying the subsequent sheet before the acquiring the information about the overlap amount, and wherein in the generating, one or more processors perform generate recording data, based on the distance information acquired by the acquisition unit, for recording the last line on the preceding sheet and a first line on the subsequent sheet in a same scan by the recording unit.

2. The recording apparatus according to claim 1, the operations further comprising judging based on the information acquired by the acquisition unit, whether image forming of recording data about the subsequent sheet and recording data about the last line on the preceding sheet is executable in the same scan by the recording unit, wherein in the generating, in a case where it is judged that the image forming is executable in the same scan by the recording unit, recording data about the first line on the subsequent sheet is generated in such a manner that a length from a leading edge of the image of the last line on the preceding sheet to a trailing edge of an image of the first line on the subsequent sheet is less than or equal to a length of the plurality of recording elements of the recording unit in the predetermined direction, and wherein in the generating, in a case where it is judged that the image forming is not executable in the same scan by the recording unit, recording data about the first line on the subsequent sheet is generated in such a manner that a length of the image of the first line on the subsequent sheet is less than or equal to the length of the plurality of recording elements of the recording unit in the predetermined direction.

3. The recording apparatus according to claim 2, wherein the sheet conveyance mechanism forms the overlap state where the trailing edge portion of the preceding sheet and the leading edge portion of the subsequent sheet overlap, and wherein in the judging, in a case where the subsequent sheet overlaps a region where the last line on the preceding sheet is to be recorded while recording of recording data about a first line from the last line on the preceding sheet is executed, It is judged that the image forming of the recording data about the last line on the preceding sheet and the recording data about the first line on the subsequent sheet is not to be executed in the same scan by the recording unit.

4. The recording apparatus according to claim 2, wherein in the judging, in a case where the recording data about the subsequent sheet is not acquired before recording of recording data about a first line from the last line on the preceding sheet is completed, It is judged that the image forming of the recording data about the last line on the preceding sheet and the recording data about the first line on the subsequent sheet is not to be executed in the same scan by the recording unit.

5. The recording apparatus according to claim 1, wherein in the acquiring, one or more processors perform the distance information is acquired after the sheet conveyance mechanism forms the overlap state, wherein in the acquiring, the distance information, in a case where a position of a trailing edge of the image on the preceding sheet is located downstream of a predetermined position in the predetermined direction in the sheet conveyance in a state where the sheet conveyance mechanism forms the overlap state, is acquired as information about a distance between a leading edge of the image of the last line on the preceding sheet and a leading edge of the image of the first line on the subsequent sheet at a time of the recording in the overlap state, and wherein in the acquiring, the distance information is not acquired, in a case where the position of the trailing edge of the image on the preceding sheet is located upstream of the predetermined position in the predetermined direction in the sheet conveyance in the state where the sheet conveyance mechanism forms the overlap state.

6. The recording apparatus according to claim 5, wherein the predetermined position is a position of a leading edge of the subsequent sheet in the state where the overlap state is formed.

7. The recording apparatus according to claim 1, the operations further comprising determining whether to convey the preceding sheet and the subsequent sheet to the recording position while maintaining the overlap state formed by the sheet conveyance mechanism, or convey the preceding sheet and the subsequent sheet to the recording position after the overlap state is released.

8. The recording apparatus according to claim 7, wherein in the determining, determine to cause the sheet conveyance unit to convey the preceding sheet and the subsequent sheet to the recording position while maintaining the overlap state in a case where an overlap amount of the overlap state formed by the sheet conveyance unit is larger than a threshold value when the subsequent sheet is conveyed to the predetermined position by the sheet conveyance mechanism, and wherein in the determining, determine to cause the sheet conveyance unit to convey the preceding sheet and the subsequent sheet to the recording position without overlapping the preceding sheet and the subsequent sheet in a case where the overlap amount is smaller than the threshold value when the subsequent sheet is conveyed to the predetermined position by the sheet conveyance mechanism.

9. The recording apparatus according to claim 7, wherein in the acquiring, in a case where one or more processors perform determining to release the overlap state, distance information about a distance between the trailing edge of the image of the last line on the preceding sheet and the leading edge of the image of the subsequent sheet when the preceding sheet and the subsequent sheet are conveyed in a non-overlap state to the recording position is acquired, based on the recording data about the preceding sheet and the subsequent sheet, and wherein in the generating, based on the distance information acquired by one or more processor, recording data for recording the last line on the preceding sheet and the first line on the subsequent sheet in the same scan by the recording unit is generated.

10. A recording method for a recording apparatus, the method comprising:

generating recording data to be used for recording by processing data;

recording an image on a sheet located at a recording position based on the recording data while a recording unit including a plurality of recording elements arranged in a predetermined direction performs scanning in a direction intersecting the predetermined direction;

forming an overlap state where a trailing edge portion of a preceding sheet and a leading edge portion of a subsequent sheet overlap, and conveying the preceding sheet and the subsequent sheet so as to convey the preceding sheet and the subsequent sheet in the overlap state to the recording position;

acquiring information about an overlap amount of the preceding sheet and the subsequent sheet when the preceding sheet and the subsequent sheet are conveyed to the recording position, based on a position of a trailing edge of an image of a last line on the preceding sheet in the predetermined direction determined based on the recording data; and acquiring distance information about a distance between a leading edge of the image of the last line on the preceding sheet and a leading edge of an image on the subsequent sheet in the predetermined direction when the preceding sheet and the subsequent sheet are conveyed to the recording position, based on the recording data and the information about the overlap amount, wherein the subsequent sheet is started to be conveyed before the information about the overlap amount is acquired, and wherein recording data for recording the last line on the preceding sheet and a first line on the subsequent sheet in a same scan by the recording unit is generated based on the acquired distance information.

* * * * *